US011664602B2

(12) United States Patent
Yamagishi et al.

(10) Patent No.: US 11,664,602 B2
(45) Date of Patent: May 30, 2023

(54) LENS, ANTENNA, AND DEVICE FOR VEHICLE

(71) Applicant: Sumitomo Electric Industries, Ltd., Osaka (JP)

(72) Inventors: Suguru Yamagishi, Osaka (JP); Ichiro Kuwayama, Osaka (JP); Katsuyuki Imai, Osaka (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/053,367

(22) PCT Filed: Apr. 22, 2019

(86) PCT No.: PCT/JP2019/017062
§ 371 (c)(1),
(2) Date: Nov. 6, 2020

(87) PCT Pub. No.: WO2019/216181
PCT Pub. Date: Nov. 14, 2019

(65) Prior Publication Data

US 2021/0194145 A1 Jun. 24, 2021

(30) Foreign Application Priority Data

May 9, 2018 (JP) ..... JP2018-090595

(51) Int. Cl.
*H01Q 15/08* (2006.01)
*H01Q 1/32* (2006.01)
(Continued)

(52) U.S. Cl.
CPC ..... *H01Q 15/08* (2013.01); *H01Q 1/32* (2013.01); *H01Q 3/245* (2013.01); *H01Q 15/04* (2013.01); *H01Q 25/008* (2013.01)

(58) Field of Classification Search
CPC ..... H01Q 15/08; H01Q 1/32; H01Q 15/04; H01Q 1/3275; H01Q 11/00; H01Q 3/14;
(Continued)

(56) References Cited

U.S. PATENT DOCUMENTS 3,566,128 A * 2/1971 Arnuad ..... H01S 3/083 372/101
4,545,238 A * 10/1985 Kinoshita ..... G01M 15/10 73/114.28
(Continued)

FOREIGN PATENT DOCUMENTS

CN 102130381 A 7/2011
CN 105552572 A * 5/2016
(Continued)

OTHER PUBLICATIONS

International Search Report and Written Opinion dated May 28, 2019 for PCT/JP2019/017062 filed on Apr. 22, 2019, 9 pages including English Translation of the International Search Report.
(Continued)

*Primary Examiner* — Robert Karacsony
(74) *Attorney, Agent, or Firm* — Xsensus LLP

(57) ABSTRACT

A lens according to the disclosure includes a dielectric having a first surface and a second surface that is spaced from the first surface and that faces the first surface in a direction of a reference axis intersecting the first surface.
(Continued)

The dielectric has an equivalent relative dielectric constant that decreases in a direction from the reference axis toward outer circumferences of the first surface and the second surface.

19 Claims, 26 Drawing Sheets

(51) Int. Cl.
*H01Q 15/04* (2006.01)
*H01Q 3/24* (2006.01)
*H01Q 25/00* (2006.01)

(58) Field of Classification Search
CPC ..... H01Q 19/062; H01Q 1/42; H01Q 3/04; H01Q 25/08; H01Q 25/007; H01Q 3/08; H01Q 19/06; H01Q 1/1221; H01Q 3/06; H01Q 3/18; H01Q 5/45; H01Q 19/104; H01Q 15/02; H01Q 1/44; H01Q 13/06; H01Q 15/23; H01Q 19/08; H01Q 9/0407; H01Q 1/22; H01Q 3/2664; H01Q 1/02; H01Q 1/1228; H01Q 1/246; H01Q 15/14; H01Q 21/065; H01Q 21/26; H01Q 1/52; H01Q 21/30; H01Q 1/38; H01Q 1/40; H01Q 19/12; H01Q 3/24; H01Q 3/30; H01Q 17/00; H01Q 9/42; H01Q 7/08; H01Q 21/28; H01Q 25/008; H01Q 1/125; H01Q 1/2291; H01Q 1/24; H01Q 1/3241; H01Q 1/36; H01Q 1/50; H01Q 13/22; H01Q 21/24; H01Q 3/16; H01Q 3/26; H01Q 5/371; H01Q 7/00; H01Q 7/06; H01Q 9/04; H01Q 9/16; H01Q 9/30; H01Q 1/3208; H01Q 21/061; H01Q 21/205; H01Q 3/2605; H01Q 5/50
See application file for complete search history.

(56) References Cited

U.S. PATENT DOCUMENTS

| | | | | |
|---|---|---|---|---|
| 6,426,814 | B1 * | 7/2002 | Berger | H01Q 21/0031 343/753 |
| 2007/0273587 | A1 * | 11/2007 | Shr | H01Q 9/40 343/700 MS |
| 2013/0082889 | A1 * | 4/2013 | Le Bars | H01Q 19/06 343/753 |
| 2016/0334451 | A1 * | 11/2016 | Ohmae | G01R 29/0885 |
| 2018/0269586 | A1 * | 9/2018 | Kawahata | H01Q 21/28 |

FOREIGN PATENT DOCUMENTS

| | | | | |
|---|---|---|---|---|
| CN | 105552572 | A | | 5/2016 |
| JP | 51-132057 | A | | 11/1976 |
| JP | 9-191212 | A | | 7/1997 |
| JP | 09191212 | A | * | 7/1997 |
| JP | 2003-511974 | A | | 3/2003 |
| JP | 2009-516933 | A | | 4/2009 |
| WO | 01/28162 | A1 | | 4/2001 |
| WO | 2006/028272 | A1 | | 3/2006 |
| WO | 2015/132846 | A1 | | 9/2015 |
| WO | 2017/090401 | A1 | | 6/2017 |

OTHER PUBLICATIONS

Yasuto, "Antenna Radio Wave Propagation", Corona Publishing Co. Ltd., Jun. 25, 1983, 5 pages with Partial English Translation.

David Lee, et al., "An Antenna for Switch Beam Multi-Beam Millimetre-Wave cellular Systems", IEEE, 2016 17th International Symposium on Antenna Technology and Applied Electromagnetics (ANTEM), Jul. 10-13, 2016, 6 pages.

* cited by examiner

LENS, ANTENNA, AND DEVICE FOR VEHICLE

CROSS-REFERENCE TO RELATED APPLICATIONS

The present application is based on PCT filing PCT/JP2019/017062, filed Apr. 22, 2019, which claims priority to JP 2018-090595, filed May 9, 2018, the entire contents of each are incorporated herein by reference.

TECHNICAL FIELD

The present disclosure relates to a lens, an antenna, and a device for vehicle.

BACKGROUND ART

PTL 1 discloses a Luneburg lens. A typical Luneburg lens is a spherical lens that has a relative dielectric constant that changes in a radial direction. The lens disclosed in PTL 1 is hemispherical and has a relative dielectric constant that changes stepwise.

NPL 1 (Mushiake Yasuto, "antenna•radio wave propagation", CORONA PUBLISHING CO., LTD., Jun. 25, 1983, P. 106) discloses that regarding a Luneburg lens, a relationship between a refractive index and a distance from the center of the lens satisfies: refractive index=square root of 2−(r/a)^2. In the above expression, r is the distance from the center of the lens, and a is the radius of the lens.

The relative dielectric constant is given as the square of the refractive index, and the relative dielectric constant of the Luneburg lens satisfies an expression: relative dielectric constant=2−(r/a)^2.

CITATION LIST

Patent Literature

PTL 1: Japanese Unexamined Patent Application Publication (Translation of PCT Application) No. 2009-516933

Non Patent Literature

NPL 1: Mushiake Yasuto, "antenna•radio wave propagation", CORONA PUBLISHING CO., LTD., Jun. 25, 1983, P. 106

SUMMARY OF INVENTION

Technical Problem

A lens according to the disclosure includes a dielectric having a first surface and a second surface that is spaced from the first surface and that faces the first surface in a direction of a reference axis intersecting the first surface. The dielectric has an equivalent relative dielectric constant that decreases in a direction from the reference axis toward outer circumferences of the first surface and the second surface.

Another aspect of the present disclosure is an antenna. An antenna according to the disclosure includes a lens including a dielectric having a first surface and a second surface that is spaced from the first surface and that faces the first surface in a direction of a reference axis intersecting the first surface, and a radio wave radiator that is disposed on outer circumferences of the first surface and the second surface. The dielectric has an equivalent relative dielectric constant that decreases in a direction from the reference axis toward the outer circumferences of the first surface and the second surface.

Another aspect of the present disclosure is a device for vehicle that includes an antenna. The antenna of the device for vehicle according to the disclosure includes a lens including a dielectric having a first surface and a second surface that is spaced from the first surface and that faces the first surface in a direction of a reference axis intersecting the first surface, and a radio wave radiator that is disposed on outer circumferences of the first surface and the second surface. The dielectric has an equivalent relative dielectric constant that decreases in a direction from the reference axis toward the outer circumferences of the first surface and the second surface.

DESCRIPTION OF EMBODIMENTS

Figure 1:
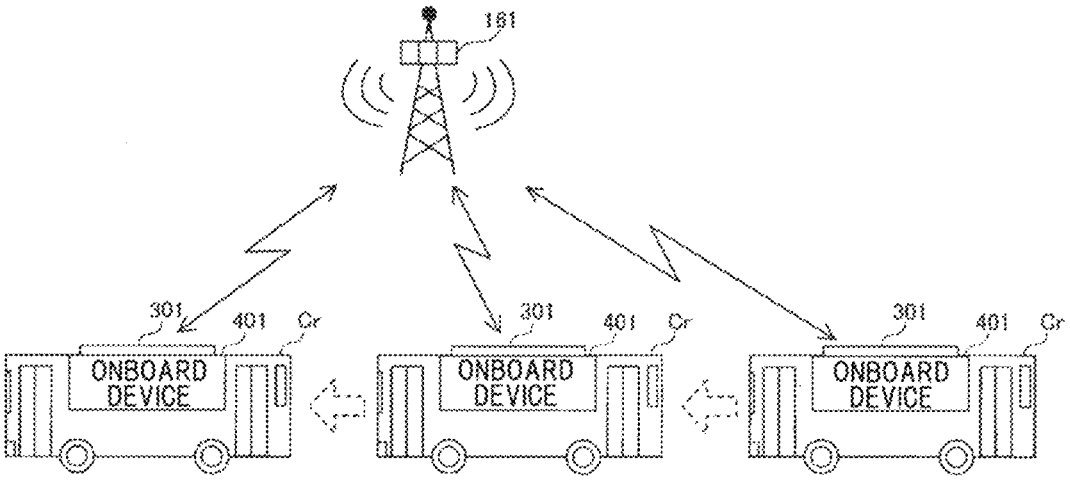
FIG. 1 illustrates components in a usage example and devices for vehicle each of which includes an antenna according to a first embodiment.

Problem to be Solved by the Present Disclosure

A spherical or hemispherical Luneburg lens can three-dimensionally change a radio wave radiation direction by three-dimensionally changing the position of a radio wave radiator along a spherical surface. However, it is necessary for the spherical or hemispherical Luneburg lens to have a relative dielectric constant that three-dimensionally changes in a radial direction from the center of a sphere or a hemisphere such that a "relationship between a refractive index and a distance from the center of the lens" disclosed in NPL 1 is satisfied. For this reason, the spherical or hemispherical Luneburg lens is difficult to manufacture.

The present inventors have found that a structure can be simplified and manufacturing is facilitated in the case where it suffices that the radiation direction two-dimensional changes.

DESCRIPTION OF EMBODIMENTS OF PRESENT DISCLOSURE

The contents of embodiments of the present disclosure will now be listed and described.

(1) A lens according to an embodiment includes a dielectric having a first surface and a second surface that is spaced from the first surface and that faces the first surface in a direction of a reference axis intersecting the first surface. The dielectric has an equivalent relative dielectric constant that decreases in a direction from the reference axis toward outer circumferences of the first surface and the second surface. Since the dielectric is a structure having the first surface and the second surface that is spaced from the first surface and that faces the first surface in the direction of the reference axis intersecting the first surface, the structure is simpler than that in the spherical or hemispherical lens. In the case where the dielectric is composed of a single kind of substance, the equivalent relative dielectric constant is equal to the relative dielectric constant of the substance of which the dielectric is composed. In the case where the dielectric is composed of kinds of substances, the equivalent relative dielectric constant corresponds to a relative dielectric constant when the substances in the direction of the reference axis are regarded as a single substance, and is obtained as the weighted average of relative dielectric constants depending on the proportion of each substance in the direction of the reference axis.

(2) In the dielectric, a first substance that has a first relative dielectric constant and a second substance that has a second relative dielectric constant larger than the first relative dielectric constant are preferably adjacent to each other in the direction of the reference axis. In this case, the equivalent relative dielectric constant corresponds to a relative dielectric constant when the first substance and the second substance are regarded as a single substance.

(3) In the dielectric, a proportion of the second substance in the direction of the reference axis preferably decreases in the direction from the reference axis toward the outer circumferences. The equivalent relative dielectric constant can be decreased by decreasing the proportion of the second substance.

(4) The second substance preferably includes multiple components that are stacked in the direction of the reference axis. A structure that decreases the equivalent relative dielectric constant can be readily obtained by stacking the multiple components in a reference direction.

(5) The second substance is preferably subjected to a cutting process. The cutting process enables a structure that decreases the equivalent relative dielectric constant to be readily obtained.

(6) The second substances are preferably located on both sides of the first substance in the direction of the reference axis. In this case, a structure in which both sides of the first substance are interposed between the second substances is obtained.

(7) The first substance is preferably air. In this case, it is not necessary to process the first substance.

(8) The first relative dielectric constant is preferably less than 2.

(9) The second relative dielectric constant is preferably 2 or more.

(10) The lens preferably further includes a member that prevents a radio wave from leaking through the first surface, and a member that prevents a radio wave from leaking through the second surface. Radio waves can be prevented from leaking through the first surface and the second surface without increasing the length of the lens in the direction of the reference axis.

(11) The lens preferably further includes a waveguide that is disposed on the outer circumferences of the first surface and the second surface. In this case, a radio wave that propagates in a waveguide mode by using the waveguide can be incident on the dielectric, and the radio wave can efficiently propagate.

(12) The lens preferably further includes a member that prevents a radio wave from leaking through the first surface, a member that prevents a radio wave from leaking through the second surface, and a waveguide that is disposed on the outer circumferences of the first surface and the second surface. The waveguide is preferably integrally formed with the member that prevents the radio wave from leaking through the first surface and the member that prevents the radio wave from leaking through the second surface. In this case, a radio wave can be prevented from leaking with more certainty when the radio wave propagates from the waveguide to the lens.

(13) A length of the dielectric in the direction of the reference axis is preferably equal to or less than twice a wavelength of a radio wave that propagates in the dielectric. That is, the length of the dielectric in the direction of the reference axis is preferably $2\lambda$ or less where X is the wavelength. The length of the dielectric in the direction of the reference axis is more preferably $1.5\lambda$ or less, further preferably $\lambda$ or less.

(14) A lens according to an embodiment is a two-dimensional Luneburg lens that changes a radio wave radiation direction into a direction parallel to a two-dimensional plane depending on a two-dimensional position of a radio wave radiator in the two-dimensional plane. The lens includes a first substance that has a first relative dielectric constant, and a second substance that is adjacent to the first substance in a direction perpendicular to the two-dimensional plane and that has a relative dielectric constant different from the first relative dielectric constant. As for the two-dimensional Luneburg lens, change in the radio wave radiation direction is preferably limited to the direction parallel to the two-dimensional plane.

(15) An antenna according to an embodiment is an antenna including a lens including a dielectric having a first surface and a second surface that is spaced from the first surface and that faces the first surface in a direction of a reference axis intersecting the first surface, and a radio wave radiator that is disposed on outer circumferences of the first surface and the second surface. The dielectric has an equivalent relative dielectric constant that decreases in the direction from the reference axis toward the outer circumferences of the first surface and the second surface.

(16) A length of the radio wave radiator in the direction of the reference axis is preferably equal to or less than a length of the dielectric in the direction of the reference axis. In this case, a radio wave can be inhibited from leaking near the boundary between the radio wave radiator and the dielectric when the radio wave is radiated.

(17) A length of the radio wave radiator in the direction of the reference axis is preferably equal to or more than a length of the dielectric in the direction of the reference axis. In this case, a radio wave can be inhibited from leaking near the boundary between the radio wave radiator and the dielectric when the radio wave is received.

(18) A length of the radio wave radiator in the direction of the reference axis is preferably equal to a length of the dielectric in the direction of the reference axis. In this case, radio waves can be inhibited from leaking near the boundary between the radio wave radiator and the dielectric when the radio wave is radiated and when the radio wave is received.

(19) A waveguide is preferably disposed between the radio wave radiator and the dielectric. In this case, a radio wave can propagate by using the waveguide between the radio wave radiator and the dielectric.

(20) A device for vehicle according to an embodiment is a device for vehicle including an antenna. The antenna includes a lens including a dielectric having a first surface and a second surface that is spaced from the first surface and that faces the first surface in a direction of a reference axis intersecting the first surface, and a radio wave radiator that is disposed on outer circumferences of the first surface and the second surface. The dielectric has an equivalent relative dielectric constant that decreases in the direction from the reference axis toward the outer circumferences of the first surface and the second surface.

Embodiments of the present disclosure will hereinafter be described with reference to the drawings. In the drawings, portions like or corresponding to each other are designated by like reference signs, and a description thereof is not repeated. At least parts of the embodiments described below may be freely combined.

First Embodiment

[Structure]

(Antenna)

FIG. 1 illustrates a usage example and the structures of devices for vehicle each of which includes an antenna according to a first embodiment of the present disclosure.

Referring to FIG. 1, each of devices for vehicle 401 is disposed in a vehicle Cr such as a bus and includes an antenna 301. The device for vehicle 401 uses the antenna 301 to communicate with a wireless base station device 161 by wireless communication, for example, in accordance with a communication method of a fifth generation mobile communication system (referred to below as "5G).

More specifically, the device for vehicle 401 detects a direction from the vehicle Cr toward the wireless base station device 161 and adjusts a main radiation direction of radio waves that are transmitted from and received by the antenna 301, based on the result of detection. The direction from the vehicle Cr toward the wireless base station device 161 can change into any direction in a horizontal plane as the vehicle Cr runs. For this reason, the antenna 301 can adjust a radio wave radiation direction and a radio wave reception direction into any direction in the horizontal plane.

The antenna 301 may be capable of vertically adjusting the radio wave radiation direction. An angle at which the radio wave radiation direction and the radio wave reception direction can be vertically adjusted may be small.

The antenna 301 is not limited to an antenna that is included in the device for vehicle 401.

The antenna 301 can be used for wireless communication in accordance with a communication method other than 5G. However, the wireless communication in accordance with the communication method of 5G, in which the degree of straightness of radio waves is high, is more suitable to use the antenna 301 that can change the radio wave radiation direction and the radio wave reception direction.

Figure 2:
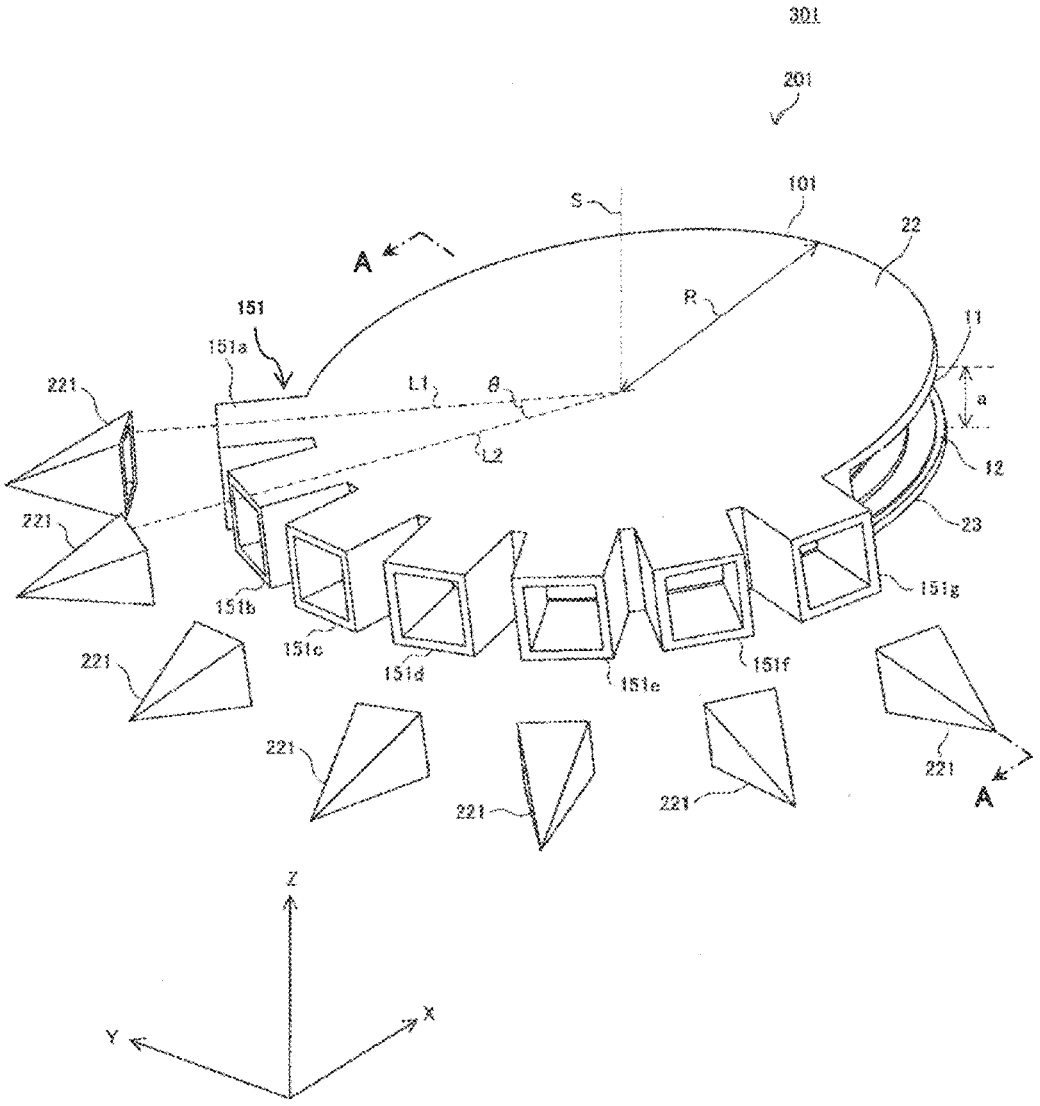
FIG. 2 illustrates the structure of the antenna according to the first embodiment.

FIG. 2 illustrates the structure of the antenna according to the first embodiment of the present disclosure.

Referring to FIG. 2, the antenna 301 is included in, for example, a device for vehicle of a mobile communication system. The antenna 301 includes a lens 201, waveguides 151 that are coupled with the lens 201, and one or more radio wave radiators 221 that are disposed around the lens 201.

Examples of the radio wave radiators 221 include a horn antenna. In FIG. 2, the seven radio wave radiators 221 are illustrated by way of example. The seven radio wave radiators 221 are disposed, for example, equiangularly. In FIG. 2, the horn antennas 221 are illustrated as members that have a quadrangular pyramid shape. The horn antennas 221 are actually members that have, for example, a truncated quadrangular pyramid shape obtained by forming an opening in a vertex portion of a quadrangular pyramid. Each waveguide is connected to the opening near the vertex of the quadrangular pyramid.

The lens 201 includes a dielectric member 101, an upper member 22, and a lower member 23. The dielectric member 101 is consist of a dielectric. The dielectric member 101 is, for example, a columnar member and has an upper surface 11 and a lower surface 12.

The upper surface 11 and the lower surface 12 of the dielectric member 101 are circular. The radii R of the upper surface 11 and the lower surface 12 are designed to be 30 mm, for example, in the case where the antenna 301 transmits and receives radio waves in a band of 28 GHz. A relationship among the speed of light c, a frequency band f, and a wavelength λ satisfies an expression: $c=f\times\lambda$, and the wavelength λ of a radio wave in a band of 28 GHz when the speed of light c satisfies c=3×10^8 m/seconds is 10.7 mm.

In the following description, an XY plane in a direction in which the upper surface 11 and the lower surface 12 extend, that is, illustrated in FIG. 2 is referred to as a horizontal plane. The direction of the normal to the upper surface 11 and the lower surface 12, that is, a Z-axis direction illustrated in FIG. 2 is referred to as a perpendicular direction. For example, in FIG. 3A and FIG. 3C, an imaginary horizontal plane P parallel to the XY plane is illustrated.

In the case where the dielectric member 101 is composed of kinds of substances, the dielectric member 101 has an equivalent relative dielectric constant Ere that is equal to the weighted average of relative dielectric constants in a thickness direction at a position a distance r away from the reference axis S and that decreases in a direction from the reference axis S that passes through the upper surface 11 and the lower surface 12 toward the outside of the dielectric member 101. An example of the reference axis S is an axis that passes through the center of the upper surface 11 and the center of the lower surface 12 and that extends in the perpendicular direction.

In the case where at the position the distance r away from the reference axis S, the dielectric member 101 is composed of a single kind of substance, the relative dielectric constant at the position of the distance r is referred to as the "equivalent relative dielectric constant $\varepsilon_{re}$". In this case, the equivalent relative dielectric constant $\varepsilon_{re}$ at the position the distance r away from the reference axis S is equal to the relative dielectric constant of the material thereof.

The number of the waveguides 151 is, for example, 7. The seven waveguides 151 are disposed at positions at which the waveguides 151 face the respective seven radio wave radiators 221. Specifically, an angle θ that is formed between a straight line L1 that passes through one of the waveguides 151 and the center of the upper surface 11 and a straight line L2 that passes through another waveguide 151 adjacent to the one of the waveguides 151 and the center of the upper surface 11 is, for example, 20°. The waveguides 151 cause radio waves to propagate between the radio wave radiators 221 and the dielectric member 101.

According to an embodiment, each waveguide 151 has a tubular shape that has a rectangular section perpendicular to a direction in which an inner space extends, that is, a waveguide direction. For example, the length of each of sides of the section is designed to be 7.112 mm in the case where the antenna 301 transmits and receives radio waves in a band of 28 GHz. The waveguide direction is a direction in which the waveguide 151 and the dielectric member 101 are connected to each other. The waveguide direction is parallel to the XY plane.

The lens 201 may not include the upper member 22, or the lower member 23, or both. In this case, the thickness of the dielectric member 101 is preferably set to a thickness equal to or more than a predetermined value. This predetermined value is a value that enables radio waves that propagate in the radial direction in the dielectric member 101 to pass through the inside of the dielectric member 101 before the radio waves leak out through the upper surface 11, or the lower surface 12 of the dielectric member 101, or both.

Figure 3A:
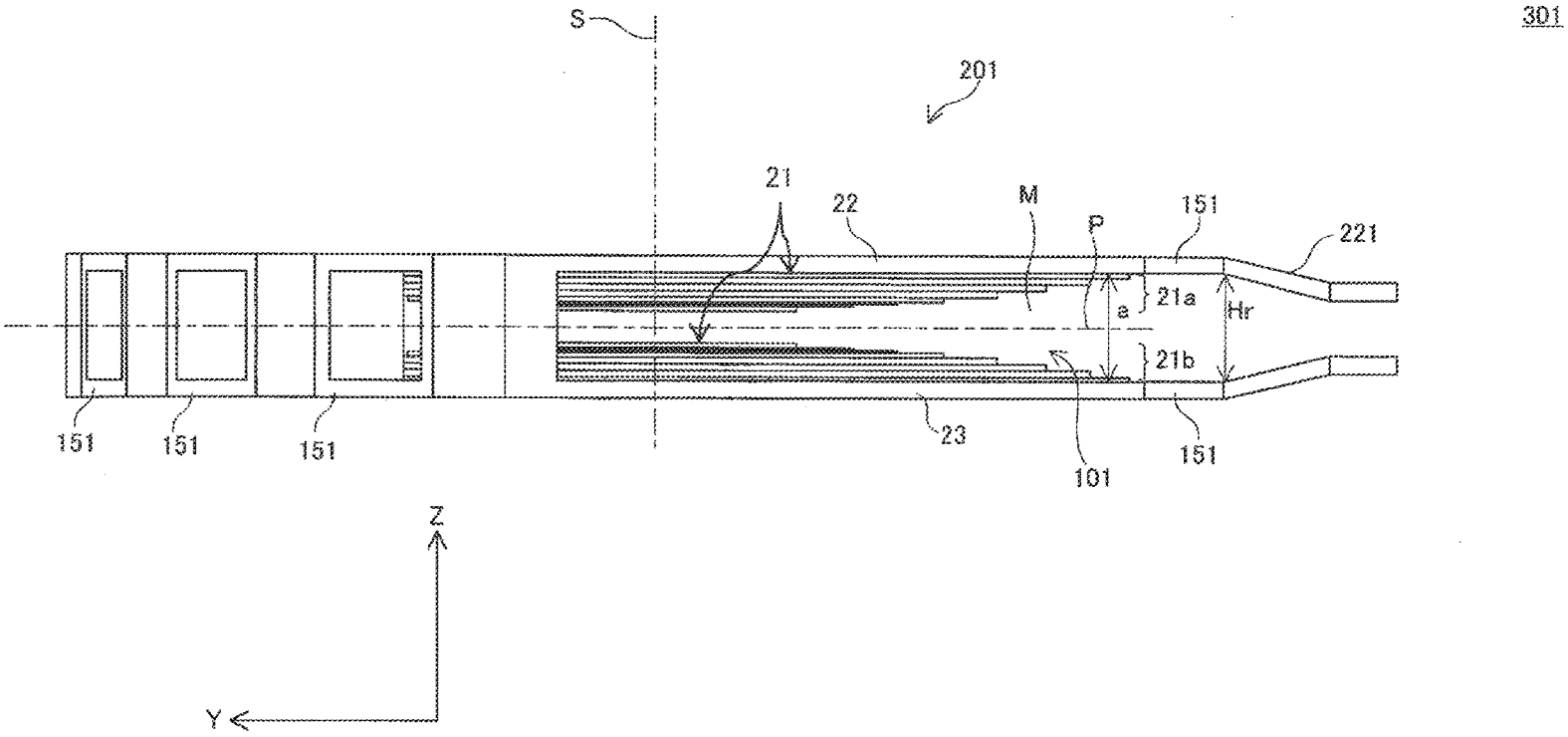
FIG. 3A illustrates the structure of a dielectric member according to the first embodiment.
Figure 3B:
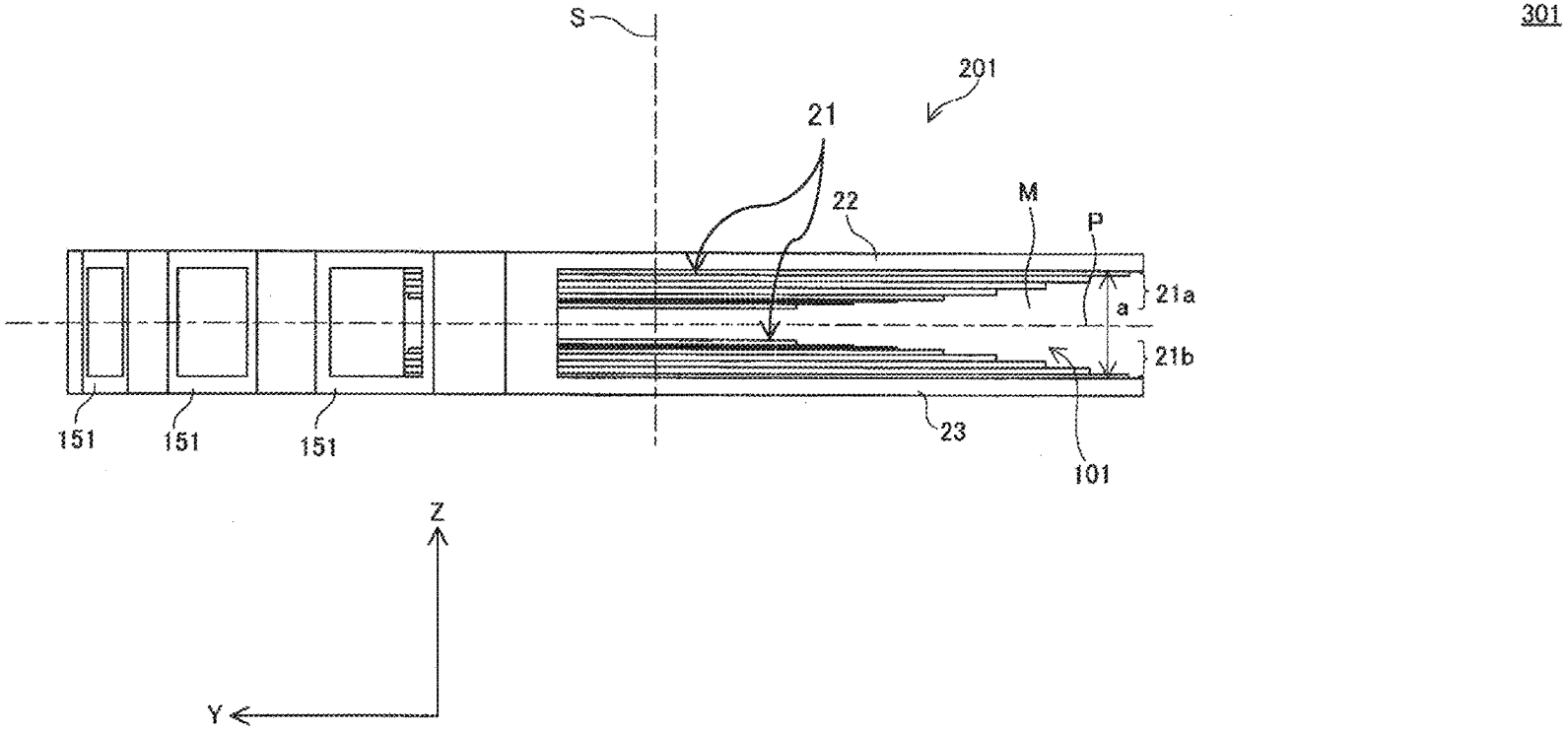
FIG. 3B is a side view of a lens according to the first embodiment.
Figure 3C:
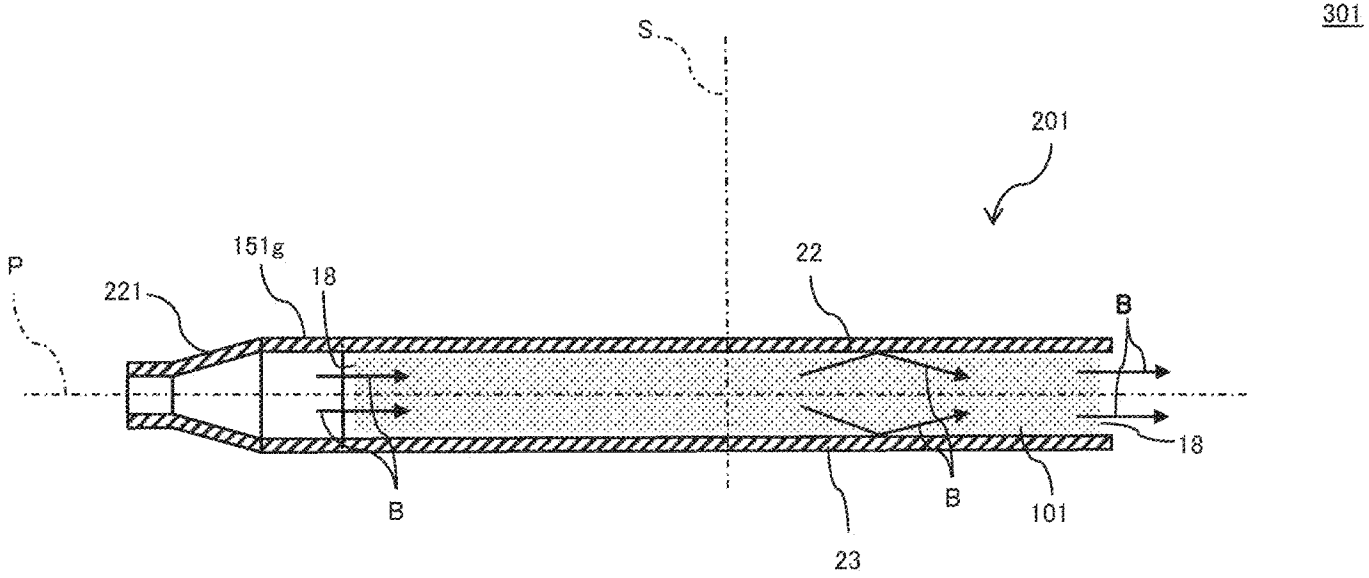
FIG. 3C is a sectional view of FIG. 2 taken along line A-A.
Figure 3D:
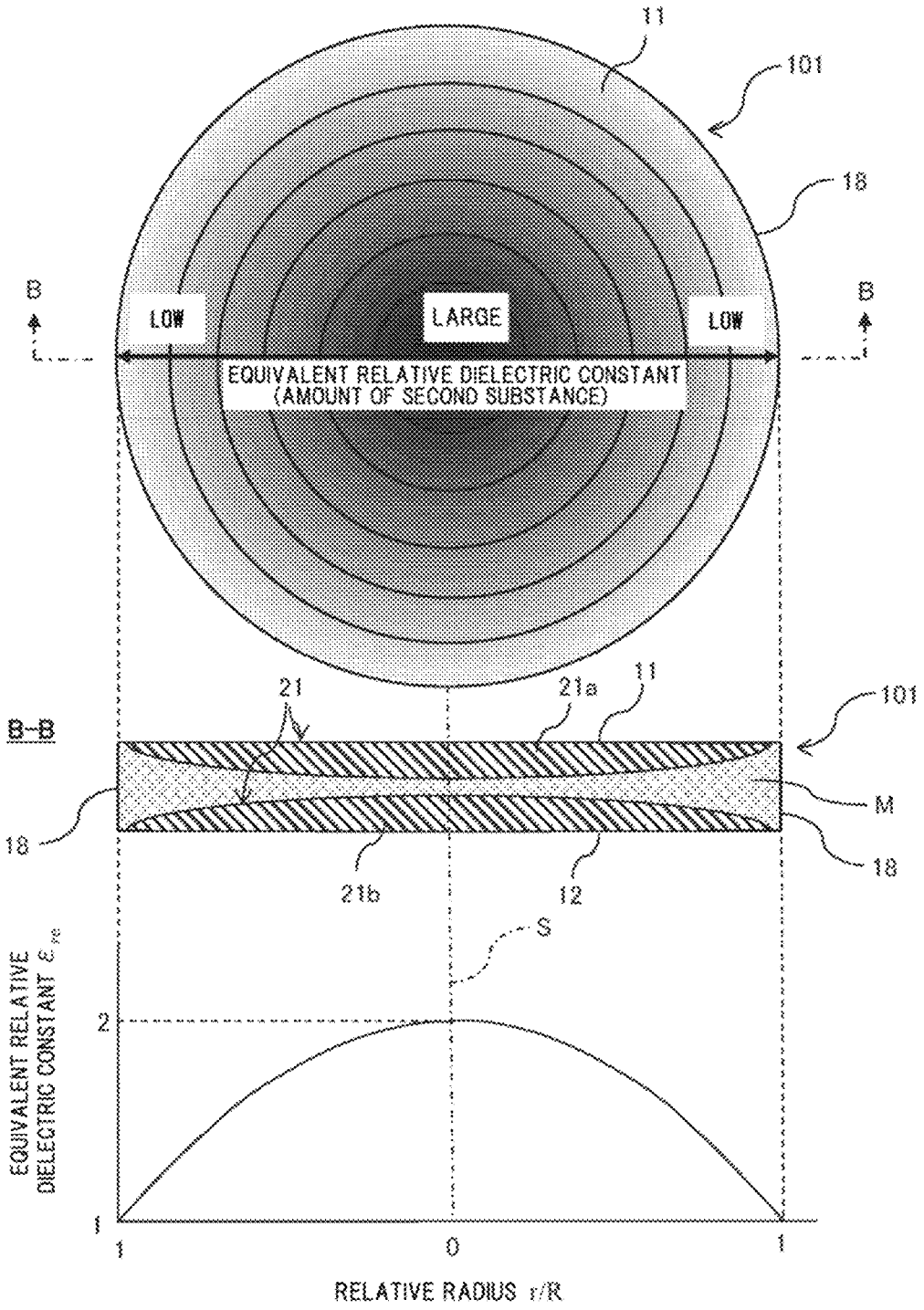
FIG. 3D illustrates the distribution of the equivalent relative dielectric constant of the dielectric.

FIG. 3A illustrates the structure of the dielectric member according to the first embodiment of the present disclosure. For convenience of description, FIG. 3A illustrates a side view of the lens 201 such that side surfaces of the waveguides 151 are illustrated at a left part of the figure and sections of the waveguides 151 and the radio wave radiator 221 are illustrated at a right part of the figure. FIG. 3B plainly illustrates a side view of the lens 201. FIG. 3C illustrates a sectional view of the lens 201 illustrated in FIG. 2 taken along line A-A. FIG. 3D illustrates the structure of the dielectric member 101. The radio wave radiator 221 illustrated in FIG. 3A and FIG. 3C has a truncated quadrangular pyramid shape obtained by forming an opening in a vertex portion of a quadrangular pyramid (see the horn antennas 221 in FIG. 2).

Referring to FIG. 3A and FIG. 3B, the dielectric member 101 includes a body portion 21 and a substance M. In the following description, the substance M is referred to as a first substance M, and a substance that is contained in the body portion 21 is referred to as a second substance in some cases. The body portion 21 and the substance M are provided between the upper member 22 and the lower member 23. The relative dielectric constant $\varepsilon_{rM}$ of the substance M is referred to as a "first relative dielectric constant $\varepsilon_{rM1}$", and the first relative dielectric constant $\varepsilon_{rM1}$ is less than 2. Here, the substance M is air. The relative dielectric constant $\varepsilon_{rM}$ of the air is 1.

The upper member 22 and the lower member 23 are composed of, for example, material containing metal or metal. As illustrated in FIG. 3C, the upper member 22 prevents radio waves B that propagate in the dielectric member 101 from leaking through the upper surface 11. Similarly, the lower member 23 prevents the radio waves B that propagate in the dielectric member 101 from leaking through the lower surface 12. That is, the upper member 22 and the lower member 23 prevent the radio waves from leaking through the upper surface 11 and the lower surface 12 and cause the radio waves B to propagate in a direction parallel to the horizontal plane P in the dielectric 10. The upper member 22 and the lower member 23 are thus waveguide members that cause the radio waves to propagate in the dielectric member 101. According to an embodiment, the upper member 22 and the lower member 23 are disposed on the upper surface 11 and the lower surface 12 of the dielectric member 101, and a location from which the radio waves can enter and/or exit the dielectric member 101 is restricted to the outer circumference 18 of the dielectric member 101. A distance a between the upper member 22 and the lower member 23 is designed to be 7.112 mm, for example, in the case where the antenna 301 transmits and receives radio waves in a band of 28 GHz. The upper member 22, the lower member 23, and the waveguides 151 are, for example, integrally formed. The distance a also corresponds to the thickness of the dielectric member 101, that is, a length in the perpendicular direction. According to an embodiment, the thickness a of the dielectric member 101 is equal to or less than one wavelength (10.7 mm). The thickness of the dielectric member 101 is preferably equal to or less than twice the wavelength (2λ), more preferably equal to or less than 1.5 times the wavelength (1.5λ), further preferably equal to or less than one wavelength (λ). Even when there are substances in the thickness direction of the dielectric member 101, sufficiently decreasing the thickness of the dielectric member 101 enables the substances to be regarded as a single kind of substance. In contrast, sufficiently increasing the thickness a of the dielectric member 101 enables a radio wave to be prevented from leaking out through the upper surface 11, or the lower surface 12 of the dielectric member 101, or both as described above. In the case where the thickness a of the dielectric member 101 is sufficiently increased, the thickness a of the dielectric member 101 is preferably equal to or more than twice the wavelength.

The height Hr of an opening portion of each radio wave radiator 221, that is, a length Hr of the radio wave radiator 221 in the perpendicular direction is equal to the distance a between the upper member 22 and the lower member 23, that is, the thickness of the dielectric member 101. This enables a radio wave to be inhibited from leaking near the boundary between the dielectric member 101 and each radio wave radiator 221.

In the case where it is not necessary to consider leakage of a radio wave near the boundary when the radio wave is received by the antenna 301, it suffices that the height Hr of the opening portion of the radio wave radiator 221 is equal to or less than the thickness of the dielectric member 101.

In the case where it is not necessary to consider leakage of a radio wave near the boundary when the radio wave is radiated from the antenna 301, it suffices that the height Hr of the opening portion of the radio wave radiator 221 is equal to or more than the thickness of the dielectric member 101.

Figure 4:
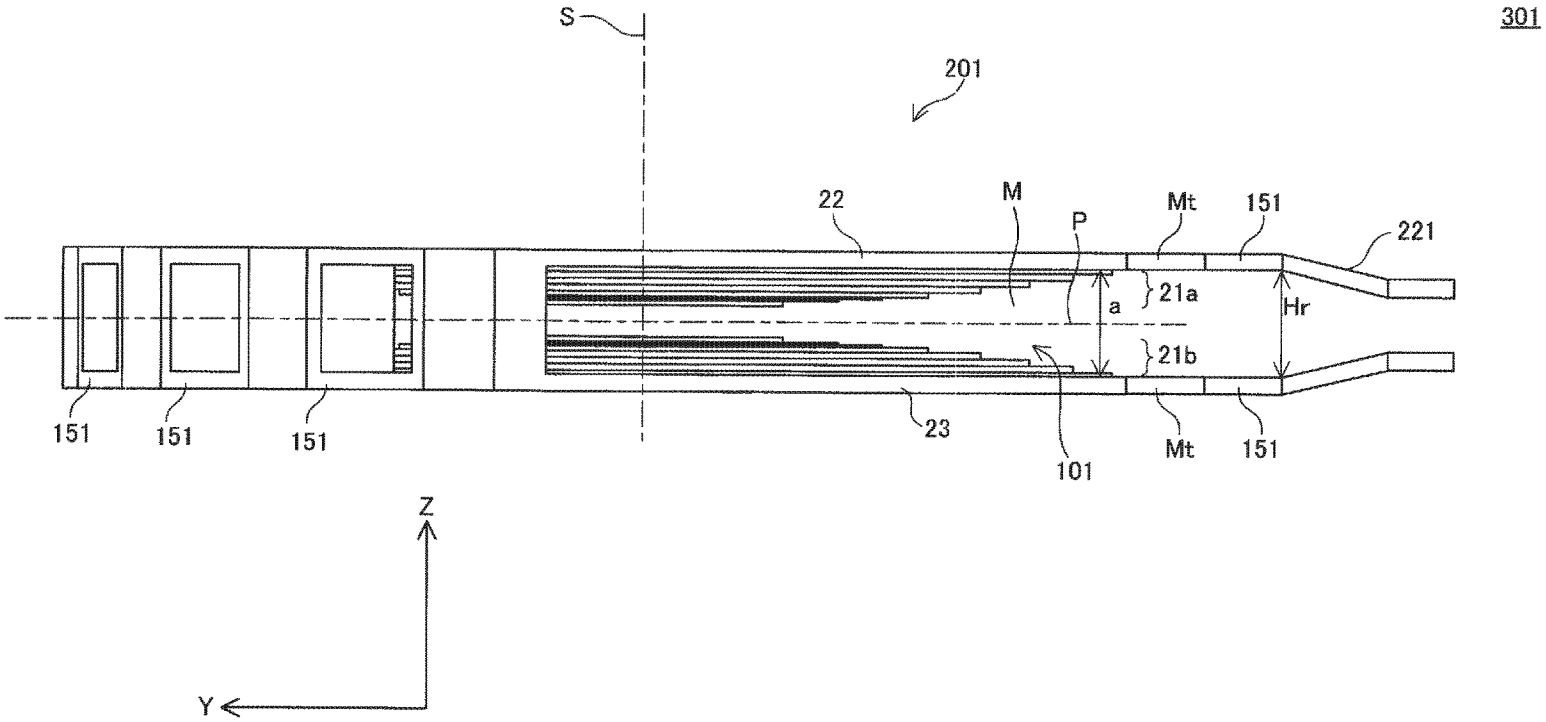
FIG. 4 is a side view of the structure of a modification to the dielectric member according to the first embodiment.

FIG. 4 illustrates the structure of a modification to the dielectric member according to the first embodiment of the present disclosure. FIG. 4 illustrates a side view of the lens 201 such that side surfaces of the waveguides 151 are illustrated at a left part of the figure and sections of the waveguides 151 and the radio wave radiator 221 are illustrated at a right part of the figure as in FIG. 3A.

Referring to FIG. 4, the upper member 22 and the lower member 23 are preferably coupled with the radio wave radiators 221 with members Mt that are composed of material that contains metal or metal and the waveguides 151 interposed therebetween. The members Mt may be integrally formed with the waveguides 151. The members Mt may be integrally formed with the upper member 22 and the lower member 23. That is, the members Mt may be tubular members that are disposed on the outer edges of the upper member 22 and the lower member 23.

In this way, metal plates, for example, extend to positions nearer than the body portion 21 of the dielectric member 101 to the radio wave radiators 221, and a radio wave is consequently prevented from leaking near the boundary between the dielectric member 101 and each radio wave radiator 221 with more certainty.

Referring to FIG. 3A and FIG. 3B again, the body portion 21 includes a first member 21*a* that is disposed near the upper member 22 and a second member 21*b* that is disposed near the lower member 23. The air that is the first substance M exists between the first member 21*a* and the second member 21*b*. In other words, the second substances are provided on both sides of the first substance M in the direction of the reference axis S. The first member 21*a* and the second member 21*b* are plane-symmetrical to each other with respect to the plane P. In FIG. 3A and FIG. 3B, the plane P is the horizontal plane that is located at the center of the dielectric member 101 in the thickness direction. That is, the body portion 21 has a plane-symmetrical structure in the perpendicular direction. In FIG. 3C, as for the dielectric member 101, only a region in which the dielectric member 101 is disposed is illustrated, and the body portion 21 and the substance M that are contained in the dielectric member 101 are not distinguished. According to an embodiment, the region in which the dielectric member 101 is disposed contains the upper surface 11 corresponding to a first surface and the lower surface 12 corresponding to a second surface. The second surface 12 is spaced from the first surface 11 in the perpendicular direction and faces the first surface 11. According to an embodiment, the region in which the dielectric member 101 is disposed has a cylindrical shape. The outer circumference 18 of the dielectric member 101 that has a tubular shape corresponds to a radio wave entrance and exit surface. The sizes of the first surface 11 and the second surface 12 may differ from each other.

The relative dielectric constants $\varepsilon_{rM}$ of the first member 21*a* and the second member 21*b* are referred to as "second relative dielectric constants $\varepsilon_{rM2}$", and the second relative dielectric constants $\varepsilon_{rM2}$ are 2 or more. The first member 21*a* and the second member 21*b* are composed of, for example, resin that has a second relative dielectric constant $\varepsilon_{rM2}$ of 3.

More specifically, the thicknesses h of the first member 21*a* and the second member 21*b* decrease in a direction from the reference axis S toward the outside of the dielectric member 101. That is, as schematically illustrated in FIG. 3D, the proportion of the body portion 21 in the direction of the reference axis S concentrically decreases in the direction from the reference axis S toward the outer circumference 18 of the dielectric member 101 in a view of a vertical section of the dielectric member 101 (in a sectional view taken along line B-B in FIG. 3D). The amount of the second substances (such as resin) that are contained in the body portion 21 is largest at the position of the reference axis S and decreases in the direction toward the outer circumference 18. In contrast, the amount of the first substance M (air) is smallest at the position of the reference axis S and increases in the direction toward the outer circumference 18. According to an embodiment, the first substance M and the second substances that are contained in the body portion 21 are thus adjacent to each other in the direction of the reference axis S. The proportion of the second substances in the direction of the reference axis S concentrically decreases in the direction from the reference axis S toward the outer circumference 18. The proportion of the first substance M in the direction of the reference axis S concentrically increases in the direction from the reference axis S toward the outer circumference 18.

Consequently, the equivalent relative dielectric constant $\varepsilon_{re}$ of the dielectric member 101 decreases in the direction from the reference axis S toward the outside of the dielectric member 101. For example, as illustrated in a diagram of a relationship between the equivalent relative dielectric constant and a relative radius in FIG. 3D, the equivalent relative dielectric constant $\varepsilon_{re}$ of a portion of the dielectric member 101 through which the reference axis S passes is about 2, and the equivalent relative dielectric constant $\varepsilon_{re}$ of the outer circumference 18 corresponding to an outer edge portion is about 1.

That is, the equivalent relative dielectric constant $\varepsilon_{re}$ at the position the distance r away from the reference axis S has a value obtained by using a proportion between the material of the first member 21*a* and the second member 21*b* and the air that is the substance M and calculating the weighted average of the relative dielectric constant $\varepsilon_{rM2}$ of the material and the relative dielectric constant $\varepsilon_{rM1}$ of the air. For this reason, the dielectric member 101 can change the equivalent relative dielectric constant $\varepsilon_{re}$ as in a spherical Luneburg lens.

In the case where at the position the distance r away from the reference axis S, the dielectric member 101 is composed of a single kind of substance as described above, the equivalent relative dielectric constant $\varepsilon_{re}$ at the position the distance r away from the reference axis S is equal to the relative dielectric constant of the material, for example, the relative dielectric constant $\varepsilon_{rM2}$ or the relative dielectric constant $\varepsilon_{rM1}$.

Specifically, the thicknesses of the first member 21*a* and the second member 21*b* at the position the distance r away from the reference axis S in the horizontal plane are referred to as thicknesses $h_r$.

A relationship between the equivalent relative dielectric constant $\varepsilon_{re}$ and the thicknesses $h_r$ satisfies an expression:

$$\varepsilon_{re}=\varepsilon_{rM1}+(\varepsilon_{rM2}-\varepsilon_{rM1})\times 2h_r/a. \quad (1)$$

Expression (1) is transformed, and the equivalent relative dielectric constant $\varepsilon_{re}$ satisfies:

$$\varepsilon_{re}=(2h_r/a)\times\varepsilon_{rM2}+((a-2h_r)/a)\times\varepsilon_{rM1}. \quad (2)$$

In expression (1) described above and expression (2) described above, a is the distance between the upper member 22 and the lower member 23 in the direction Z of the reference axis and corresponds to the thickness of the dielectric member 101. R is the radii of the upper surface 11 and the lower surface 12 of the dielectric member 101, $\varepsilon_{rM2}$ is the relative dielectric constant of a material of which the body portion 21 is composed, that is, the second substances, and $\varepsilon_{rM1}$ is the relative dielectric constant of the air that is the first substance.

That is, the equivalent relative dielectric constant $\varepsilon_{re}$ is the total value of a value obtained by multiplying $2h_r/a$ by the second relative dielectric constant $\varepsilon_{rM2}$ of the body portion 21 and a value obtained by multiplying (a−2hr)/a by the first relative dielectric constant $\varepsilon_{rM1}$ of the air. $2h_r/a$ represents the proportion of the thickness $2h_r$ of the body portion 21 at the position of the distance r to the thickness a of the dielectric member 101. The thickness $2h_r$ of the body portion 21 is the sum of the thickness $h_r$ of the first member 21*a* and the thickness $h_r$ of the material of the second member 21*b*. $((a-2h_r)/a)$ represents the proportion of the thickness of the air at the position of the distance r to the thickness a of the dielectric member 101.

(Body Portion)

Figure 5:
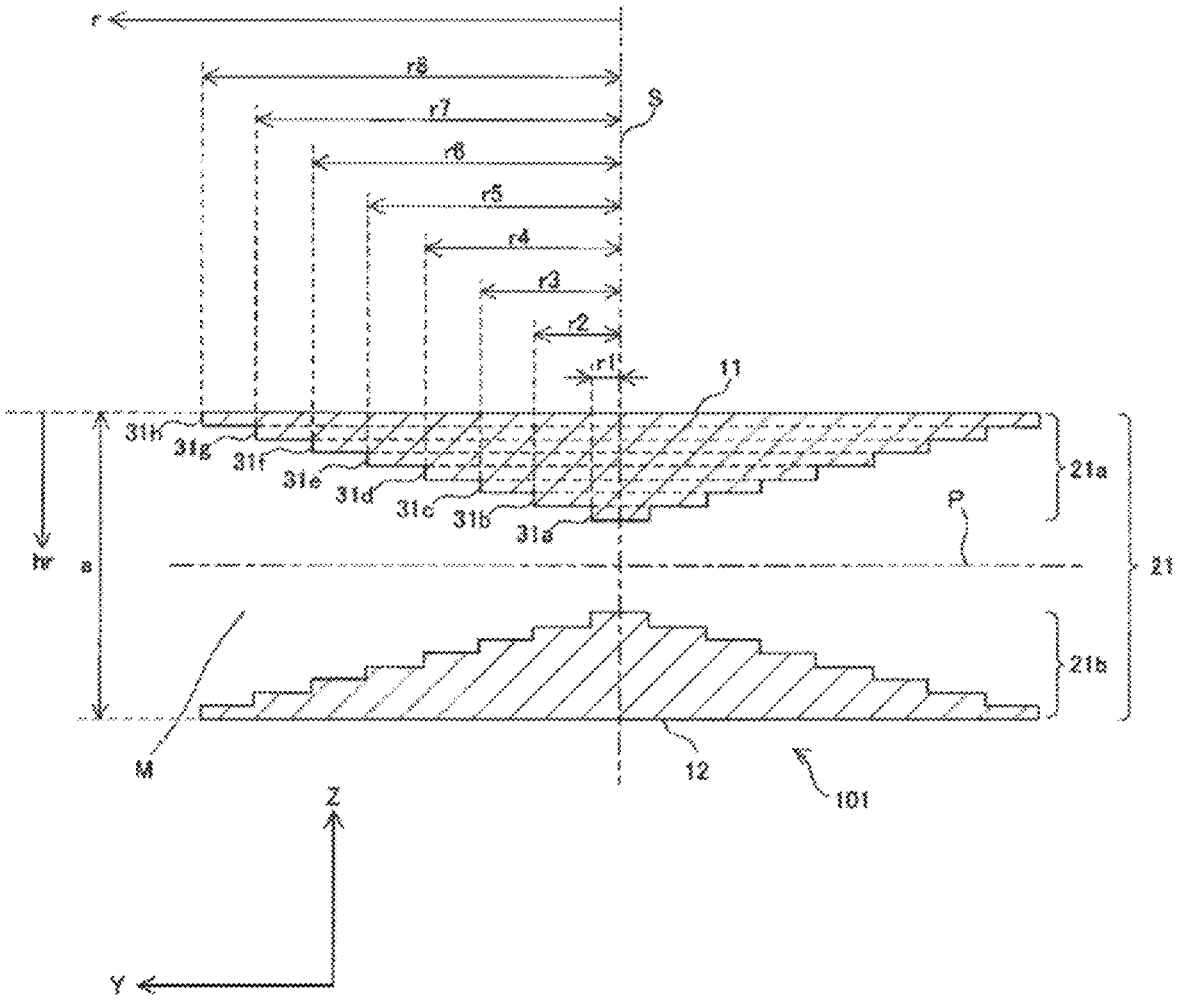
FIG. 5 illustrates the structure of a body portion of the dielectric member according to the first embodiment.

FIG. 5 illustrates the structure of the body portion of the dielectric member according to the first embodiment of the present disclosure.

Referring to FIG. 5, the first member 21*a* and the second member 21*b* of the body portion 21 are plane-symmetrical with respect to the plane P as described above. The first member 21*a* has the upper surface 11, and the second member 21*b* has the lower surface 12. The structure of the first member 21*a* will now be described.

The first member 21*a* includes components 31 that are stacked in a direction parallel to the reference axis S. An example of each component 31 is a disk-shaped member that has a circular main surface, and the reference axis S passes through the center of the main surface. Here, the body portion 21 includes the eight components 31, that is, components 31*a*, 31*b*, 31*c*, 31*d*, 31*e*, 31*f*, 31*g*, and 31*h*.

The components 31*a* to 31*h* contain the same substance and have the same relative dielectric constant $\varepsilon_{rM}$. The components 31*a* to 31*h* are stacked downward from the upper member 22 in order of the components 31*h*, 31*g*, 31*f*, 31*e*, 31*d*, 31*c*, 31*b*, and 31*a*. The radii of the components 31*a* to 31*h* are referred to as radii r1 to r8, and the radii r1 to r8 satisfy a relationship in magnitude: r1<r2<r3<r4<r5<r6<r7<r8. That is, the sizes of the components 31*a* to 31*h* in the radial direction differ from each other. As a component of the components 31*a* to 31*h* is nearer to the plane P at the center of the dielectric member 101 in the thickness direction, the radius thereof is smaller than those of the others.

The second member 21*b* has the same structure as that of the first member 21*a* except that these are plane-symmetrical with respect to the plane P. That is, the second member 21*b* includes components that have different radii and that are stacked upward from the lower member 23. As a component of the components that are included in the second member 21*b* is nearer to the plane P at the center of the dielectric member 101 in the thickness direction, the radius thereof is smaller than those of the others. The thickness $h_r$ of each of the first member 21*a* and the second member 21*b* is equal to the total value of the thicknesses of the component or components 31 that are located at the position of the distance r.

Figure 6:
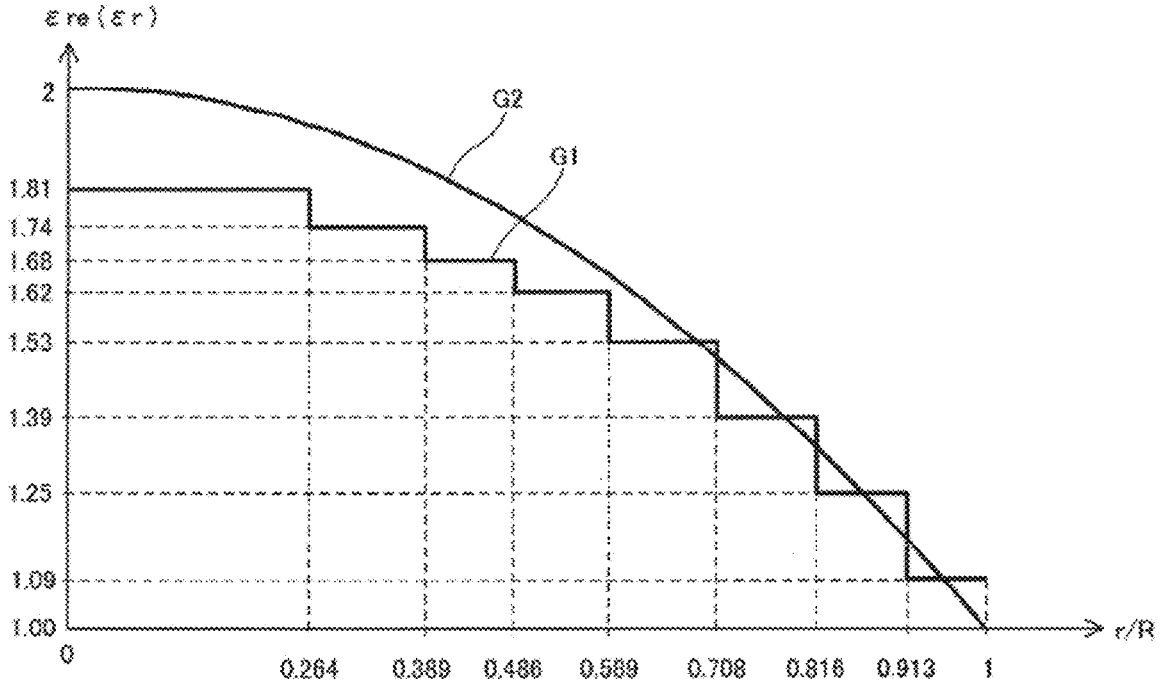
FIG. 6 is a graph illustrating a relationship between a distance from a reference axis of the dielectric member illustrated in FIG. 5 and the equivalent relative dielectric constant of the dielectric member.

FIG. 6 is a graph illustrating a relationship between a distance from the reference axis of the dielectric member illustrated in FIG. 5 and the equivalent relative dielectric constant of the dielectric member. In FIG. 6, the vertical axis represents the equivalent relative dielectric constant $\varepsilon_{re}$, and the horizontal axis represents the proportion r/R of the distance r from the reference axis S to the radius R of the dielectric member 101.

In addition to a graph G1 illustrating the relationship between the distance r from the reference axis S of the dielectric member 101 and the equivalent relative dielectric constant $\varepsilon_{re}$ of the dielectric member 101, FIG. 6 illustrates a graph G2 illustrating a relationship between the distance r from the center of a Luneburg lens that has a radius R and a spherical shape and the dielectric constant $\varepsilon_r$ of the Luneburg lens.

Referring to FIG. 6, as for the Luneburg lens that has a spherical shape, relationship between the distance r from the center of the lens and the relative dielectric constant $\varepsilon_r$ satisfies an expression:

$$\varepsilon_r=2-(r/R)^2, \quad (3)$$

as illustrated in the graph G2. That is, the relative dielectric constant $\varepsilon_r$ continuously changes in the radial direction. Expression (3) is referred to as a Luneburg lens relational expression. The Luneburg lens that has a spherical shape has relative dielectric constant distribution that satisfies the Luneburg lens relational expression of expression (3) in any radial direction in an XYZ three-dimensional space.

Specifically, in the case where the radius R of the dielectric member 101 is 30 mm, the dielectric constant $\varepsilon_r$ at the center of the lens, that is, a position at which the distance r satisfies r=0 mm is 2. The dielectric constant $\varepsilon_r$ at a position near a surface of the lens, that is, a position at which the distance r satisfies r=30 mm is 1.

The dielectric member 101 of the lens 201 according to the present embodiment has relative dielectric constant distribution such that the distance r from the reference axis S and the relative dielectric constant $\varepsilon_r$ satisfy the Luneburg lens relational expression given as expression (3) in the horizontal plane P that is the XY plane. The dielectric member 101 according to the present embodiment does not have the relative dielectric constant distribution that satisfies the Luneburg lens relational expression in the perpendicular direction that is a Z-direction. Thus, the lens 201 according to the present embodiment is a two-dimensional Luneburg lens that satisfies the Luneburg lens relational expression of expression (3) only in the radial direction in an XY two-dimensional space.

Figure 3E:
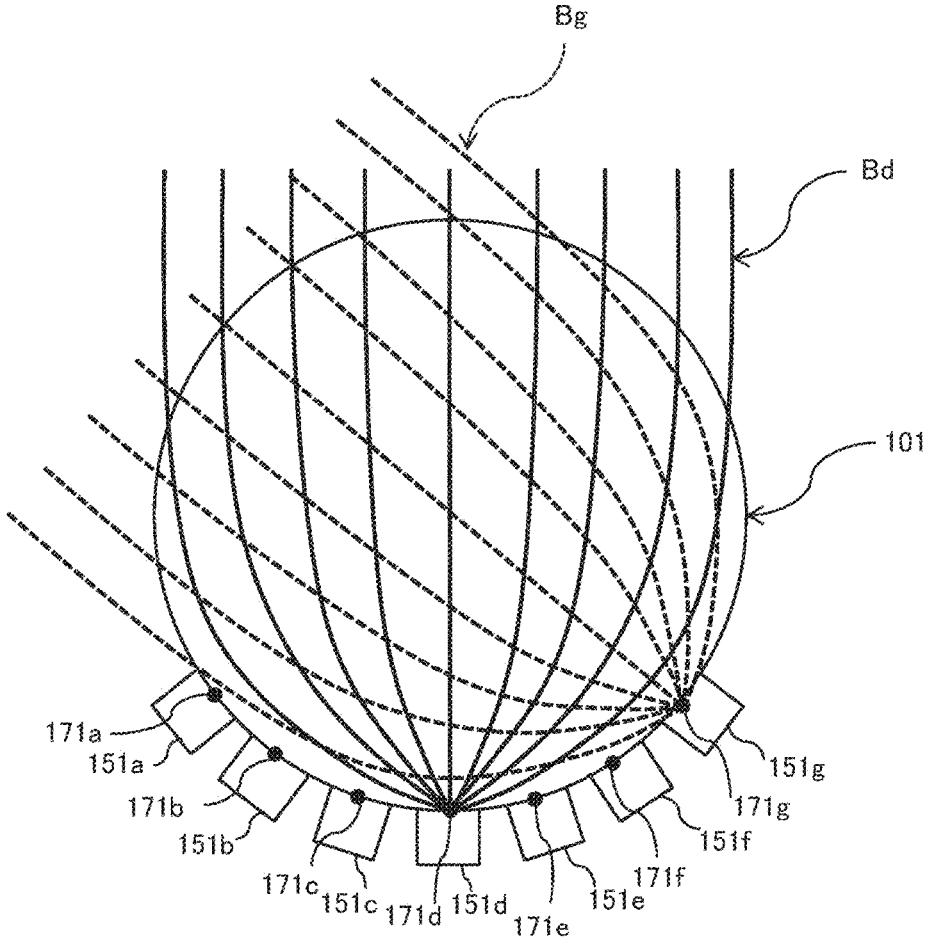
FIG. 3E illustrates focusing of radio waves in the lens.

The lens 201 according to the present embodiment has the relative dielectric constant distribution that satisfies the Luneburg lens relational expression given as expression (3) in the horizontal plane and consequently defines focal points 171*a* to 171*g* on which radio waves are focused on the outer circumference 18 or near the outer circumference 18 of the lens 201 as illustrated in FIG. 3E. Waveguides 151*a* to 151*g* cause radio waves to enter the dielectric member 101 from the focal points 171*a* to 171*g* on the outer circumference 18 or near the outer circumference 18 when the radio waves are radiated. The waveguides 151*a* to 151*g* cause radio waves that reach the positions of the focal points 171*a* to 171*g* on the outer circumference 18 or near the outer circumference 18 to propagate toward the radio wave radiators 221 when the radio waves are received.

The lens 201 according to the present embodiment enables change into a direction parallel to the two-dimensional plane P depending on the two-dimensional position of the waveguides 151 or the radio wave radiators 221 in the two-dimensional plane P. That is, as illustrated in FIG. 3E, the direction of radio waves Bd that are transmitted and received via the waveguide 151*d* differs from the direction of radio waves Bg that are transmitted and received via the waveguide 151*g*.

As for the dielectric member 101 according to the first embodiment of the present disclosure, the equivalent relative dielectric constant $\varepsilon_{re}$ decreases in the direction from the reference axis S toward the outside of the dielectric member 101 as described above. That is, the thickness $h_r$ of the body portion 21 of the dielectric member 101 is designed such that the desired equivalent relative dielectric constant $\varepsilon_{re}$ is obtained.

For example, the thickness $h_r$ is designed such that the equivalent relative dielectric constant $\varepsilon_{re}$ of the dielectric member 101 satisfies expression (3) for the Luneburg lens.

Specifically, the thickness $h_r$ is designed to satisfy an expression:

$$h_r=\{a\times(2-(r/R)^2-\varepsilon_{rM1})\}/\{(\varepsilon_{rM2}-\varepsilon_{rM1})/2\}, \quad (4)$$

from the relationship of expression (2) described above and expression (3) described above, that is, a relationship:

$$\varepsilon_{re}=(2h_r/a)\times\varepsilon_{rM2}+((a-2h_r)/a)\times\varepsilon_{rM1}=2-(r/R)^2.$$

In addition, the thickness $h_r$ is designed to satisfy, for example, expression (2) described above in the case where the equivalent relative dielectric constant $\varepsilon_{re}$ of the dielectric member 101 is changed stepwise so as to approximate to the relative dielectric constant $\varepsilon_r$ of the Luneburg lens as illustrated in the graph G1 in FIG. 6.

For example, the thickness $h_r$ is designed such that as the distance r increases, the equivalent relative dielectric constant $\varepsilon_{re}$ decreases to 1.81, 1.74, 1.68, 1.62, 1.53, 1.39, 1.25, or 1.09, that is, decreases stepwise from 2 to 1.

The radii and thicknesses of the components 31*a* to 31*h* are designed, for example, to satisfy expression (1) described above such that the equivalent relative dielectric constant $\varepsilon_{re}$ of the dielectric member 101 is the equivalent relative dielectric constant in the graph G1 illustrated in FIG. 6.

Here, the radius R of the dielectric member 101 is 30 mm, the thickness a of the dielectric member 101 is 7.112 mm, and the relative dielectric constants $\varepsilon_{rM2}$ of the first member 21*a* and the second member 21*b* are 2.2.

In this case, for example, the thickness $h_r$ is designed such that $\varepsilon_{re}$=1.81 is satisfied at positions at which the distance r satisfies 0 mm≤r≤7.9 mm, that is, 0≤r/R≤0.264, specifically is designed to be about 2.40 mm. For example, the thickness $h_r$ is designed such that $\varepsilon_{re}$=1.74 is satisfied at positions at which the distance r satisfies 7.9 mm≤r≤11.7 mm, that is, 0.264≤r/R≤0.389, specifically is designed to be about 2.19 mm.

For example, the thickness $h_r$ is designed such that $\varepsilon_{re}$=1.68 is satisfied at positions at which the distance r satisfies 11.7 mm≤r≤14.6 mm, that is, 0.389≤r/R≤0.486, specifically, is designed to be about 2.02 mm. For example, the thickness $h_r$ is designed such that $\varepsilon_{re}$=1.62 is satisfied at positions at which the distance r satisfies 14.6 mm≤r≤17.7 mm, that is, 0.486≤r/R≤0.589, specifically is designed to be about 1.84 mm.

For example, the thickness $h_r$ is designed such that $\varepsilon_{re}$=1.53 is satisfied at positions at which the distance r satisfies 17.7 mm≤r≤21.2 mm, that is, 0.589≤r/R≤0.708, specifically, is designed to be about 1.57 mm. For example, the thickness $h_r$ is designed such that $\varepsilon_{re}$=1.39 is satisfied at positions at which the distance r satisfies 21.2 mm≤r≤24.5 mm, that is, 0.708≤r/R≤0.816, specifically is designed to be about 1.16 mm.

For example, the thickness $h_r$ is designed such that $\varepsilon_{re}$=1.25 is satisfied at positions at which the distance r satisfies 24.5 mm≤r≤27.4 mm, that is, 0.816≤r/R≤0.913, specifically is designed to be about 0.74 mm. For example, the thickness $h_r$ is designed such that $\varepsilon_{re}$=1.09 is satisfied at positions at which the distance r satisfies 27.4 mm≤r≤30 mm, that is, 0.913≤r/R≤1, specifically is designed to be about 0.27 mm.

Two or more adjacent components of the components 31*a* to 31*h* may be integrally formed.

The lens 201 is not limited to a structure in which the reference axis S passes through the center of the upper surface 11 and the center of the lower surface 12, provided that the lens 201 is located at a position at which the radio wave radiation direction is in a desired settable range, and the reference axis S may shift from the center of the upper surface 11, or the center of the lower surface 12, or both.

The dielectric member 101 is not limited to the columnar member, provided that the dielectric member 101 has the upper surface 11 and the lower surface 12.

[Manufacturing Method]

Figure 7:
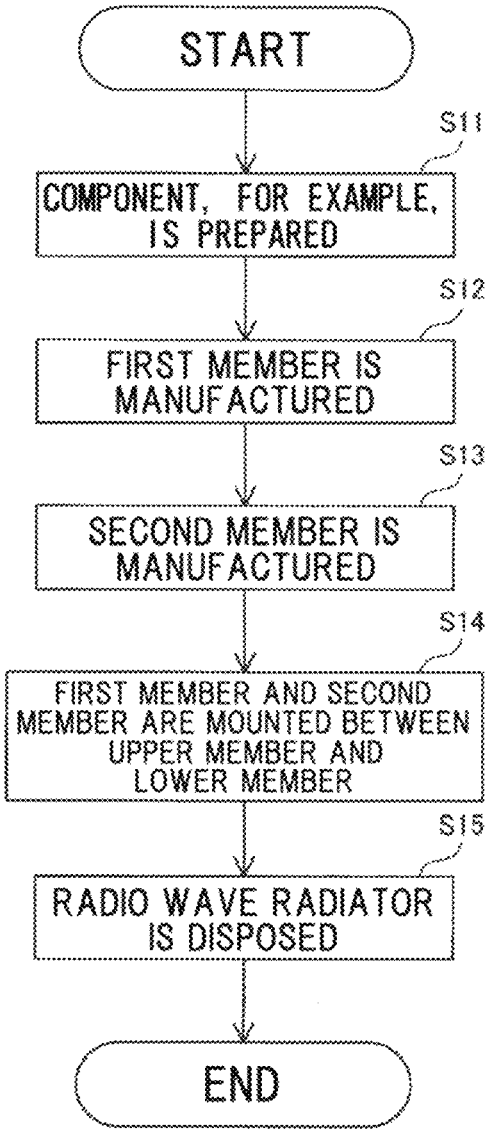
FIG. 7 illustrates a flowchart in which procedures for a method of manufacturing the antenna according to the first embodiment are defined.

FIG. 7 illustrates a flowchart in which procedures for a method of manufacturing the antenna according to the first embodiment of the present disclosure are defined.

Referring to FIG. 7, an operator first prepares a member that includes the components 31*a* to 31*h* of the first member 21*a*, the components 31*a* to 31*h* of the second member 21*b*, the upper member 22, the lower member 23, and the waveguides 151, and the radio wave radiators 221 (step S11).

Subsequently, the operator manufactures the first member 21*a* by stacking the components 31*a* to 31*h* in the direction parallel to the reference axis S (step S12).

Subsequently, the operator manufactures the second member 21*b* by stacking the components 31*a* to 31*h* in the direction parallel to the reference axis S (step S13).

Subsequently, the operator mounts the first member 21*a* and the second member 21*b* between the upper member 22 and the lower member 23. Specifically, the operator mounts the first member 21*a* on the upper member 22 and mounts the second member 21*b* on the lower member 23 (step S14).

The operator disposes the radio wave radiators 221 at positions at which the radio wave radiators 221 face the respective waveguides 151 around the lens 201 in which the first member 21*a* and the second member 21*b* are mounted (step S15).

The order of stacking the components 31*a* to 31*h* (step S12) and stacking the components 31*a* to 31*h* (step S13) may be switched.

The first member 21*a* and the second member 21*b* may be integrally manufactured by a cutting process. In this case, at step S11, a component A that is used for the first member 21*a* and a component B that is used for the second member 21*b* are prepared instead of the components 31*a* to 31*h* of the first member 21*a* and the components 31*a* to 31*h* of the second member 21*b*. At step S12, a cutting process is performed on the component A to manufacture the first member 21*a*. At step S13, a cutting process is performed on the component B to manufacture the second member 21*b*.

[Directivity of Antenna]

(Horizontal Plane Directivity of Horizontally Polarized Wave)

Figure 8:
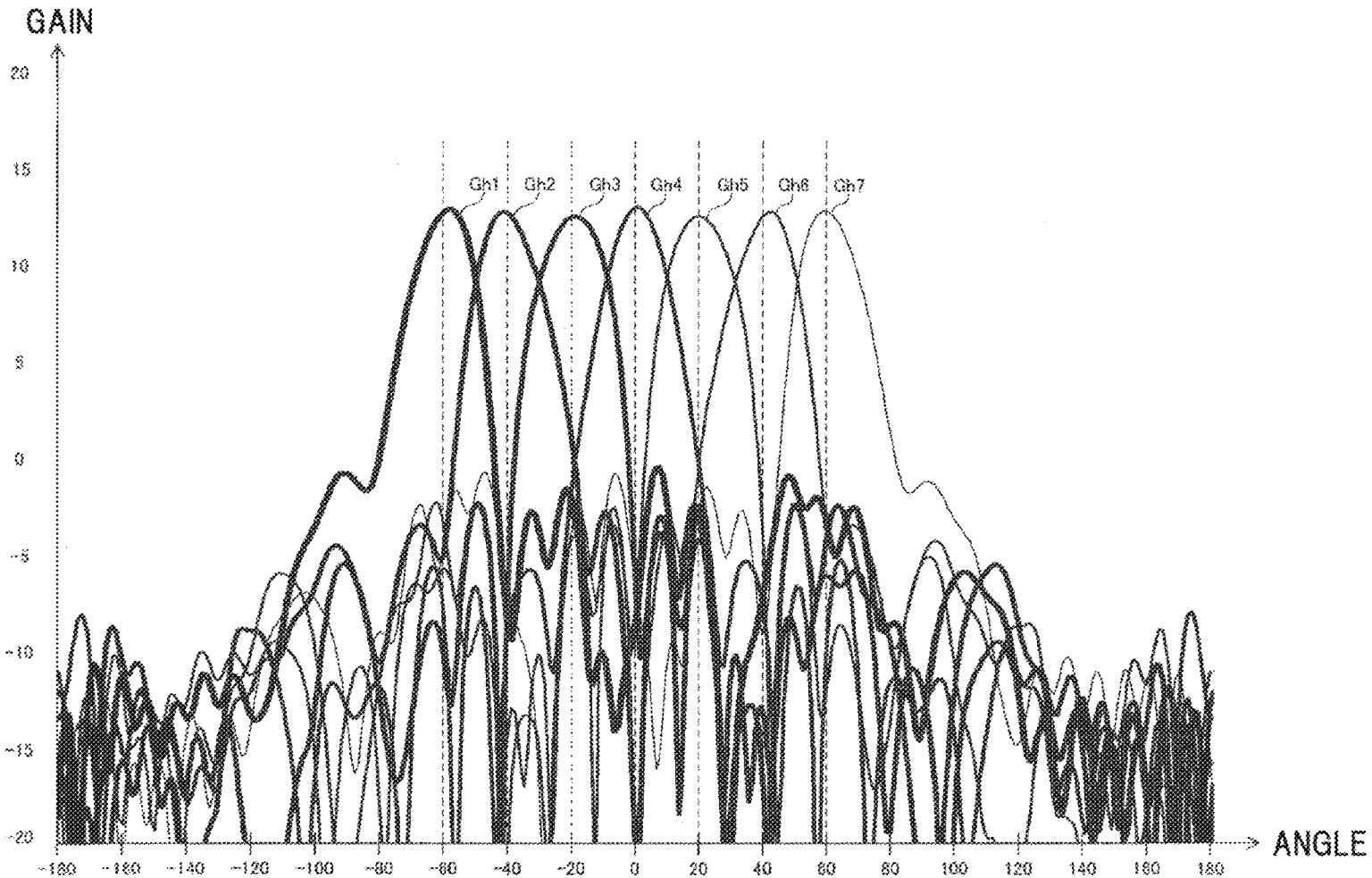
FIG. 8 is a graph illustrating the horizontal plane directivity of horizontally polarized waves that are transmitted and received by the antenna according to the first embodiment.

FIG. 8 is a graph illustrating the horizontal plane directivity of horizontally polarized waves that are transmitted and received by the antenna according to the first embodiment of the present disclosure. In the graph illustrated in FIG. 8, the vertical axis represents gain, and the horizontal axis represents the radio wave radiation direction of the horizontally polarized waves that are transmitted and received in the waveguides 151 illustrated in FIG. 2 in the horizontal plane. The graph illustrated in FIG. 8 represents the result of a simulation of the horizontal plane directivity of the horizontally polarized waves in the case where a relationship between the equivalent relative dielectric constant $\varepsilon_{re}$ and the distance r from the reference axis S of the dielectric member 101 in the antenna 301 is the same as the relationship illustrated in FIG. 6, and radio waves in a band of 28 GHz are transmitted and received. The radius R and thickness a of the dielectric member 101 and the relative dielectric constants $\varepsilon_{rM2}$ of the first member 21*a* and the second member 21*b* are equal to those in the case of FIG. 6, and a detailed description is not repeated herein.

Figure 3F:
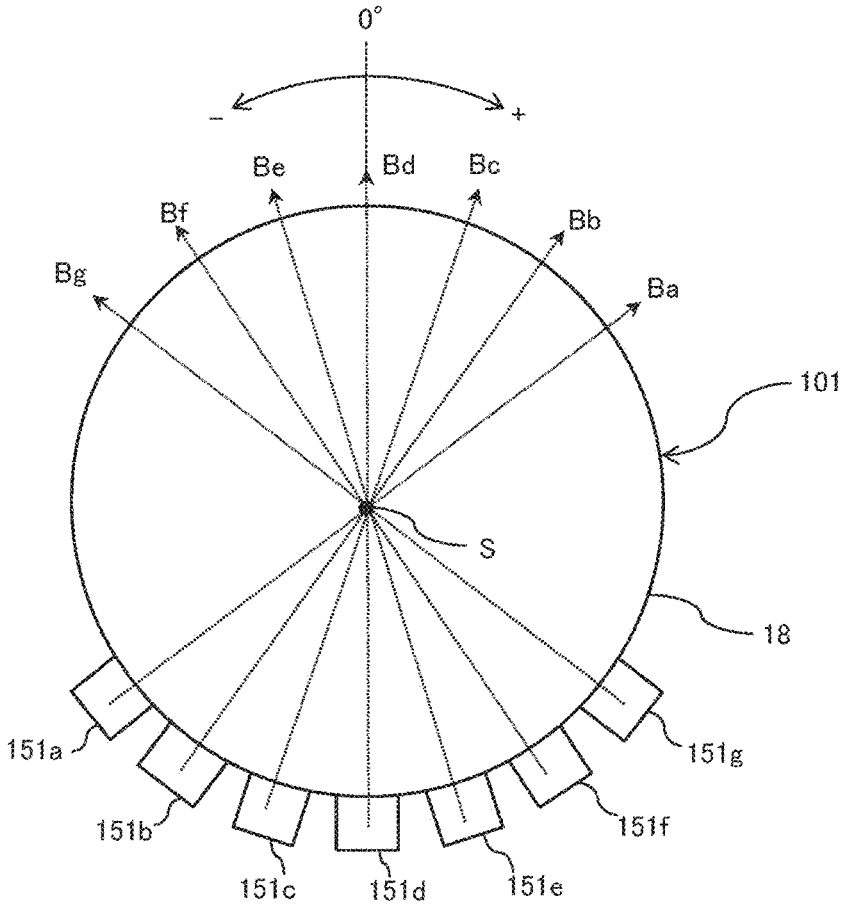
FIG. 3F illustrates a radio wave radiation direction.

Referring to FIG. 8, the seven waveguides 151 illustrated in FIG. 2 are referred to herein as the waveguides 151*a*, 151*b*, 151*c*, 151*d*, 151*e*, 151*f*, and 151*g*. As illustrated in FIG. 3F, radio waves that are transmitted and received in the waveguide 151*a* are designated by Ba, radio waves that are transmitted and received in the waveguide 151*b* are designated by Bb, radio waves that are transmitted and received in the waveguide 151*c* are designated by Bc, radio waves that are transmitted and received in the waveguide 151*d* are designated by Bd, radio waves that are transmitted and received in the waveguide 151*e* are designated by Be, radio waves that are transmitted and received in the waveguide 151*f* are designated by Bf, and radio waves that are transmitted and received in the waveguide 151*g* are designated by Bg. Graphs illustrating the directivity of the horizontally polarized waves that are transmitted and received in the waveguides 151*a* to 151*g* in the horizontal plane are graphs Gh1, Gh2, Gh3, Gh4, Gh5, Gh6, and Gh7. The graph Gh1 is related to the radio waves Bg, the graph Gh2 is related to the radio waves Bf, the graph Gh3 is related to the radio waves Be, the graph Gh4 is related to the radio waves Bd, the graph Gh5 is related to the radio waves Bc, the graph Gh6 is related to the radio waves Bb, and the graph Gh7 is related to the radio waves Ba.

As illustrated in the graph Gh4 and FIG. 3F, the main radiation direction of the horizontally polarized waves of the radio waves Bd that are transmitted and received in the waveguide 151*d* is standard, that is, 0°. In this case, as illustrated in the graphs Gh1 to Gh7, the main radiation directions of the horizontally polarized waves that are transmitted and received in the waveguides 151*a* to 151*g* in the horizontal plane are about −60°, −40°, −20°, 0°, +20°, +40°, and +60°.

The antenna 301 can thus change the radio wave radiation direction of the horizontally polarized waves with the gain ensured.

(Horizontal Plane Directivity of Vertically Polarized Wave)

Figure 9:
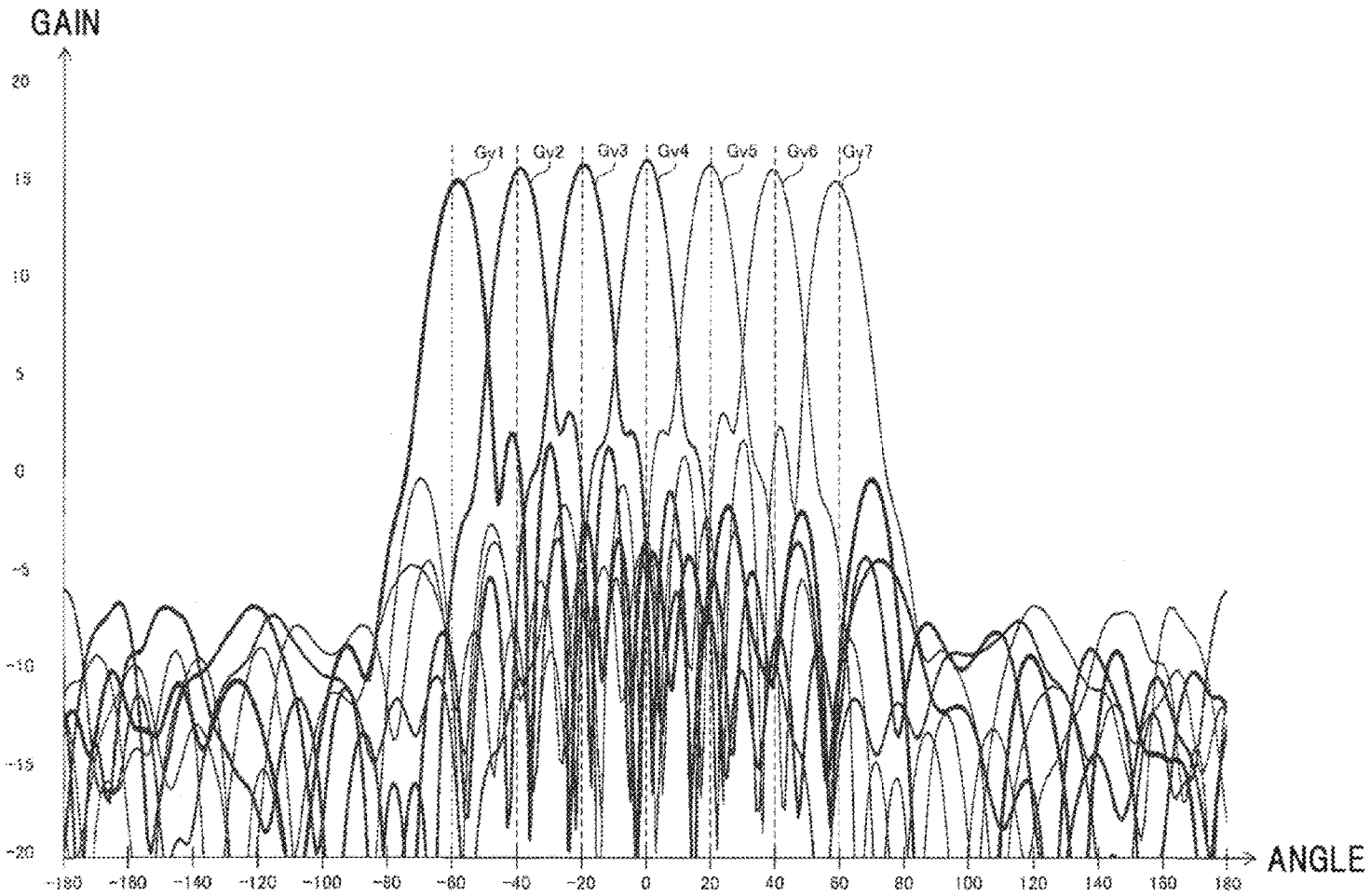
FIG. 9 is a graph illustrating the horizontal plane directivity of vertically polarized waves that are transmitted and received by the antenna according to the first embodiment.

FIG. 9 is a graph illustrating the horizontal plane directivity of vertically polarized waves that are transmitted and received by the antenna according to the first embodiment of the present disclosure. In the graph illustrated in FIG. 9, the vertical axis represents the gain, and the horizontal axis represents the radio wave radiation direction of the vertically polarized waves that are transmitted and received in the waveguides 151 illustrated in FIG. 2 in the horizontal plane. The graph illustrated in FIG. 9 represents the result of a simulation of the horizontal plane directivity of the vertically polarized waves in the case where it is assumed that the relationship between the equivalent relative dielectric constant $\varepsilon_{re}$ and the distance r from the reference axis S of the dielectric member 101 in the antenna 301 is the same as the relationship illustrated in FIG. 6, and that radio waves in a band of 28 GHz are transmitted and received. The radius R and thickness a of the dielectric member 101 and the relative dielectric constants $\varepsilon_{rM2}$ of the first member 21*a* and the second member 21*b* are equal to those in the case of FIG. 6, and a detailed description is not repeated herein.

Referring to FIG. 9, graphs illustrating the directivity of the vertically polarized waves that are transmitted and received in the waveguides 151*a* to 151*g* in the horizontal plane are graphs Gv1, Gv2, Gv3, Gv4, Gv5, Gv6, and Gv7. The graph Gv1 is related to the radio wave Bg, the graph Gv2 is related to the radio wave Bf, the graph Gv3 is related to the radio wave Be, the graph Gv4 is related to the radio wave Bd, the graph Gv5 is related to the radio wave Bc, the graph Gv6 is related to the radio wave Bb, and the graph Gv7 is related to the radio wave Ba.

As illustrated in the graph Gv4 and FIG. 3F, the main radiation direction of the vertically polarized waves of the radio waves Bd that are transmitted and received in the waveguide 151*d* is standard, that is, 0°. In this case, as illustrated in the graphs Gv1 to Gv7, the main radiation directions of the vertically polarized waves that are transmitted and received in the waveguides 151*a* to 151*g* in the horizontal plane are about −60°, −40°, −20°, 0°, +20°, +40°, and +60°.

The antenna 301 can thus change the radio wave radiation direction of the vertically polarized waves with the gain ensured as in the horizontally polarized waves. That is, the antenna 301 can change the radio wave radiation direction by changing the waveguides 151 that are to be used to transmit and receive the radio waves.

The antenna 301 is not limited to a structure including the waveguides 151 but may include a single waveguide 151. In this case, the radio wave radiation direction can be changed from Ba into Bg, for example, by changing the position or direction of the single waveguide 151 from that of the waveguide 151*a* into that of the waveguide 151*g* in FIG. 2 and FIG. 3F. The antenna 301 according to the present embodiment enables the change into the direction parallel to the two-dimensional plane P depending on the two-dimensional position of the waveguides 151 or the radio wave radiators 221 in the two-dimensional plane P. However, change into a direction perpendicular to the two-dimensional plane P is restricted.

The components 31*a* to 31*h* illustrated in FIG. 5 are not limited to a structure in which these have the same relative dielectric constant $\varepsilon_{rM}$. For example, at least a component 31 of the components 31*a* to 31*h* may have a relative dielectric constant $\varepsilon_{rM}$ that differs from those of the other components 31.

For example, the relative dielectric constant $\varepsilon_{rM}$ of the components 31*a* to 31*d* illustrated in FIG. 5 may differ from the relative dielectric constant $\varepsilon_{rM}$ of the components 31*e* to 31*h*. In this case, the equivalent relative dielectric constant $\varepsilon_{re}$ of the lens 201 is equal to, for example, the weighted average of the relative dielectric constant $\varepsilon_{rM}$ of the material of the components 31*a* to 31*d*, the relative dielectric constant $\varepsilon_{rM}$ of the material of the components 31*e* to 31*h*, and the relative dielectric constant $\varepsilon_{rM}$ of the air.

Also, with this structure, the thicknesses of the components 31*a* to 31*h* can be designed such that the equivalent relative dielectric constant $\varepsilon_{re}$ approximates to, for example, that in the graph G1 illustrated in FIG. 6 as in the case where the components 31*a* to 31*h* have the same relative dielectric constant $\varepsilon_{rM}$.

The first member 21*a* and the second member 21*b* may be formed, for example, by performing a cutting process on an integral component instead of stacking the components 31.

[First Modification]

Figure 10:
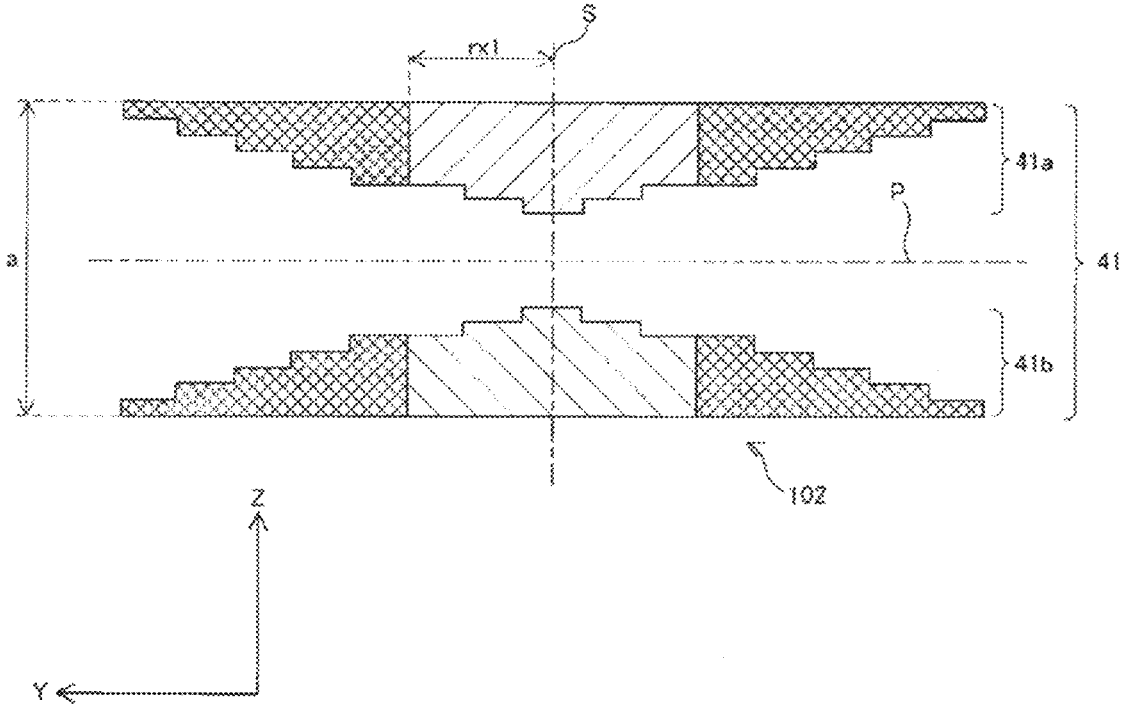
FIG. 10 illustrates the structure of a body portion of a dielectric member according to a first modification to the first embodiment.

FIG. 10 illustrates the structure of a body portion of a dielectric member according to a first modification to the first embodiment of the present disclosure.

Referring to FIG. 10, a body portion 41 of a dielectric member 102 according to the first modification includes a first member 41*a* and a second member 41*b*. The first member 41*a* and the second member 41*b* are plane-symmetrical to each other with the plane P centered.

The first member 41*a* includes members that have different relative dielectric constants $\varepsilon_{rM}$. For example, the first member 41*a* is composed of a material that has a relative dielectric constant $\varepsilon_{rM}$ of about 3 at a position at which the distance r from the reference axis S is 0 mm to a predetermined value rx1 and a material that has a relative dielectric constant $\varepsilon_{rM}$ of about 2 at a position at which the distance r is more than the predetermined value rx1. The material that has a relative dielectric constant $\varepsilon_{rM}$ of about 2 is, for example, polytetrafluoroethylene or polyethylene.

The thickness h of the first member 41*a* decreases stepwise in a direction from the reference axis S toward the outside of the dielectric member 102.

The structure of the second member 41*b* is the same as that of the first member 41*a*.

Consequently, the equivalent relative dielectric constant $\varepsilon_{re}$ of the dielectric member 102 decreases stepwise in the direction from the reference axis S toward the outside of the dielectric member 102. Specifically, the equivalent relative dielectric constant $\varepsilon_{re}$ of a portion of the dielectric member 102 through which the reference axis S passes is about 2, and the equivalent relative dielectric constant $\varepsilon_{re}$ of an outer edge portion thereof is about 1.

In the dielectric member 102 according to the first modification to the first embodiment of the present disclosure, a member that has a low relative dielectric constant $\varepsilon_{rM}$ is thus used for the portion at which the distance r is more than the predetermined value rx1, and the thickness h of this portion is consequently more than that in the dielectric member 101 illustrated in FIG. 3. For this reason, the strength of the dielectric member 102 can increased.

[Second Modification]

Figure 11:
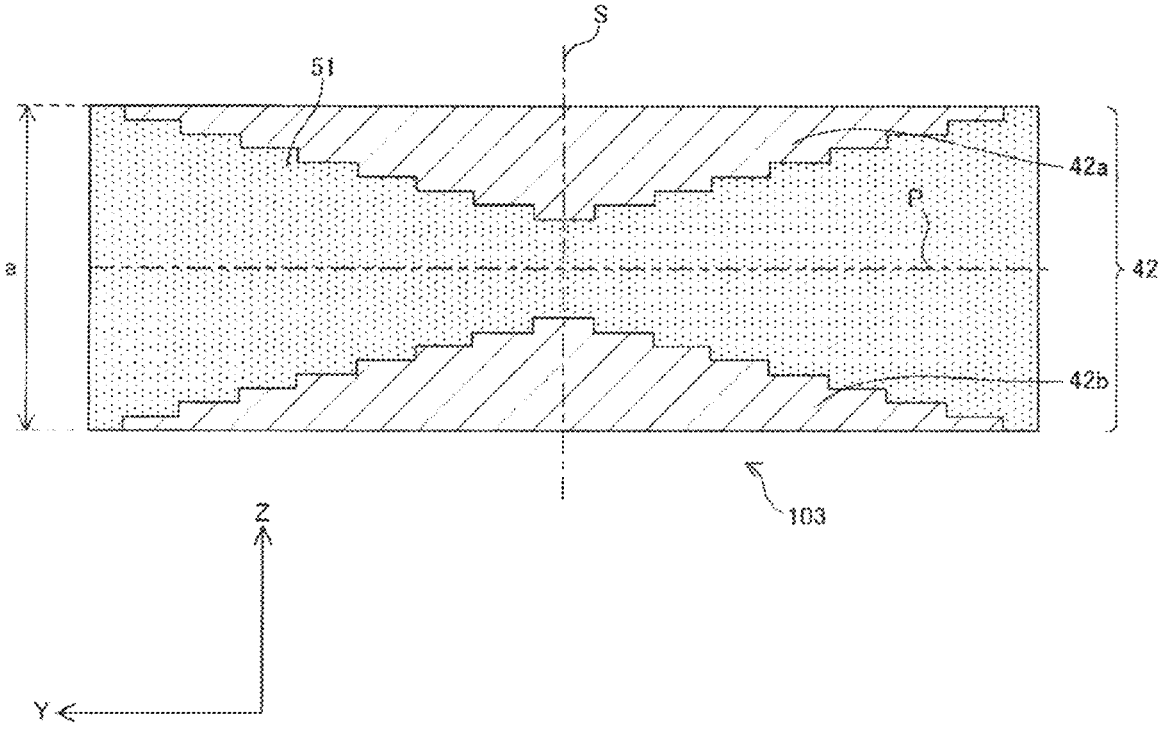
FIG. 11 illustrates the structure of a body portion of a dielectric member according to a second modification to the first embodiment.

FIG. 11 illustrates the structure of a body portion of a dielectric member according to a second modification to the first embodiment of the present disclosure.

Referring to FIG. 11, a body portion 42 of a dielectric member 103 according to the second modification includes a first member 42*a* and a second member 42*b*. The first member 42*a* and the second member 42*b* are plane-symmetrical to each other with the plane P centered.

The structures of the first member 42*a* and the second member 42*b* are the same as the structures of the first member 21*a* and the second member 21*b* illustrated in FIG. 5. That is, the thicknesses h of the first member 42*a* and the second member 42*b* decrease stepwise in a direction from the reference axis S toward the outside of the dielectric member 103.

The dielectric member 103 further includes a low relative dielectric constant member 51 that has a relative dielectric constant $\varepsilon_{rM}$ of no less than 1 and less than 2 as the substance M that has a relative dielectric constant $\varepsilon_{rM}$ of less than 2. Examples of the low relative dielectric constant member 51 include polystyrene containing bubbles, that is, polystyrene foam and is disposed so as to fill a space between the first member 42*a* and the second member 42*b*.

In the lens 201 according to the second modification to the first embodiment of the present disclosure, the dielectric member 103 thus includes the low relative dielectric constant member 51 that has a relative dielectric constant $\varepsilon_{rM}$ of more than 1 as the substance M that has a relative dielectric constant $\varepsilon_{rM}$ of less than 2.

With this structure, for example, the body portion 42 is supported by using the low relative dielectric constant member 51, and the strength of the dielectric member 103 can be increased.

The dielectric member 103 is not limited to a structure in which the low relative dielectric constant member 51 fills the space between the first member 42*a* and the second member 42*b*. For example, the first member 42*a* and the second member 42*b* may be connected to each other along the plane P, and the low relative dielectric constant member 51 may surround the first member 42*a* and the second member 42*b*.

[Third Modification]

Figure 12:
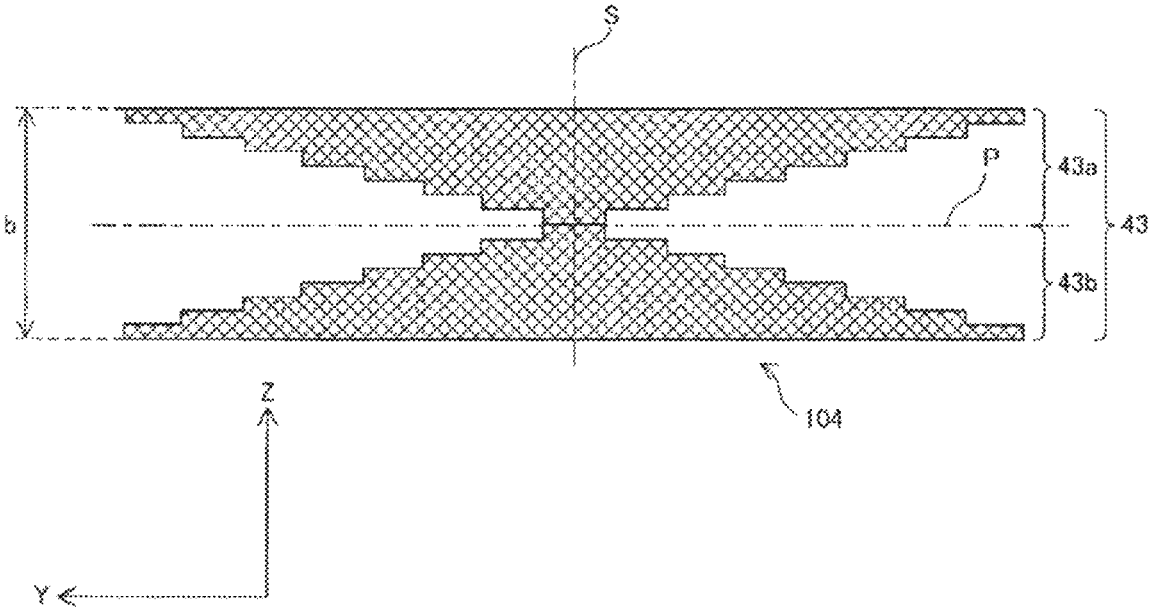
FIG. 12 illustrates the structure of a body portion of a dielectric member according to a third modification to the first embodiment.

FIG. 12 illustrates the structure of a body portion of a dielectric member according to a third modification to the first embodiment of the present disclosure.

Referring to FIG. 12, a body portion 43 of a dielectric member 104 according to the third modification includes a first member 43*a* and a second member 43*b*. The first member 43*a* and the second member 43*b* are plane-symmetrical to each other with the plane P centered.

The structures of the first member 43*a* and the second member 43*b* are the same as the structures of the first member 21*a* and the second member 21*b* illustrated in FIG. 5 except for a structure described below. That is, the thicknesses h of the first member 43*a* and the second member 43*b* decrease stepwise in a direction from the reference axis S toward the outside of the dielectric member 104.

More specifically, the first member 43*a* and the second member 43*b* are composed of material that has a relative dielectric constant $\varepsilon_{rM}$ of about 2 and are connected to each other at a portion through which the reference axis S passes. Consequently, the equivalent relative dielectric constant $\varepsilon_{re}$ of the portion of the dielectric member 104 through which the reference axis S passes is about 2, and the equivalent relative dielectric constant $\varepsilon_{re}$ of an outer edge portion of the dielectric member 104 is about 1.

In the lens 201 according to the third modification to the first embodiment of the present disclosure, the body portion 43 includes the first member 43*a* and the second member 43*b* that is connected to the first member 43*a* at the portion through which the reference axis S passes.

With this structure, the strength of the dielectric member 104 can be increased in the case where the body portion 43 includes the members.

Since the dielectric member 104 is composed of the material that has a relative dielectric constant $\varepsilon_{rM}$ of about 2, the volume of the substance M can be smaller than that in the case where the dielectric member 104 is composed of material that has a relative dielectric constant $\varepsilon_{rM}$ of about 3. That is, the length of the body portion 43 in the perpendicular direction, that is, the thickness b thereof is less than the distance a illustrated in FIG. 5, and the size of the dielectric member 104 can be decreased.

[Fourth Modification]

Figure 13:
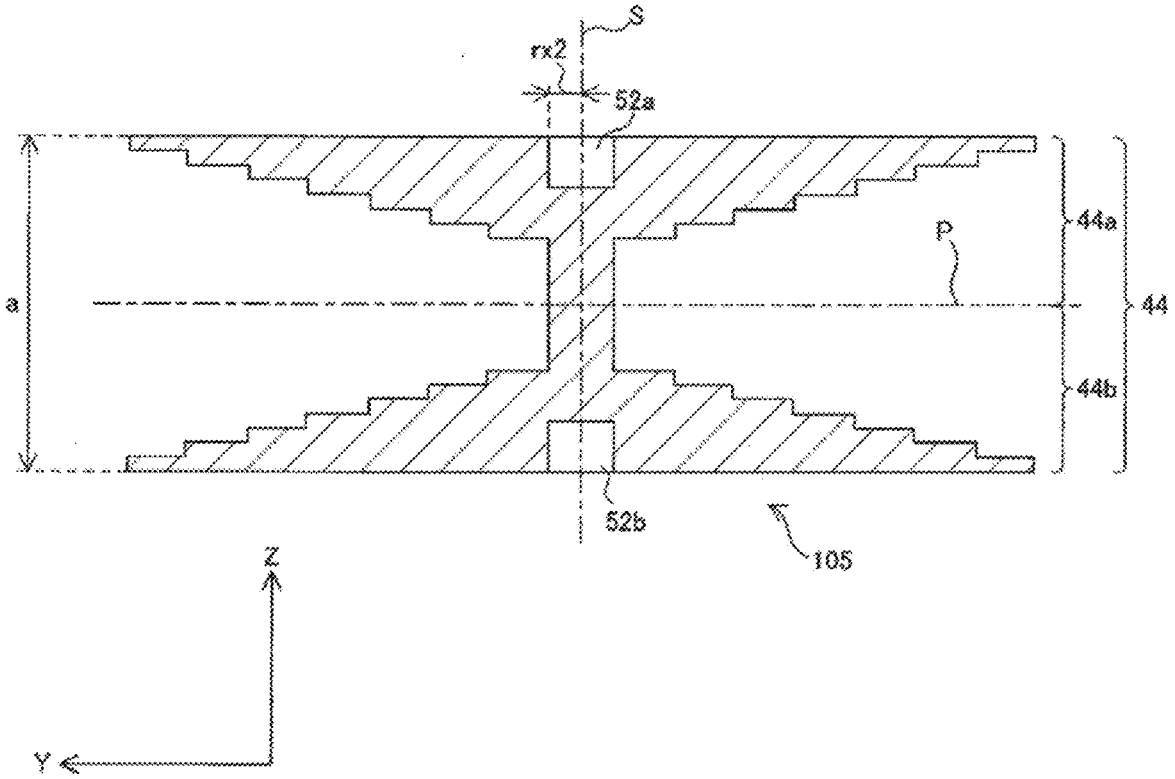
FIG. 13 illustrates the structure of a body portion of a dielectric member according to a fourth modification to the first embodiment.

FIG. 13 illustrates the structure of a body portion of a dielectric member according to a fourth modification to the first embodiment of the present disclosure.

Referring to FIG. 13, a body portion 44 of a dielectric member 105 according to a fourth modification includes a first member 44*a* and a second member 44*b*. The first member 44*a* and the second member 44*b* are plane-symmetrical to each other with the plane P centered.

The structures of the first member 44*a* and the second member 44*b* are the same as the structures of the first member 21*a* and the second member 21*b* illustrated in FIG. 5 except for a structure described below.

That is, the first member 44*a* and the second member 44*b* are composed of material that has a relative dielectric constant $\varepsilon_{rM}$ of about 3. The thicknesses h of the first member 44*a* and the second member 44*b* decrease stepwise in a direction from the reference axis S toward the outside of the dielectric member 105.

More specifically, the first member 44*a* and the second member 44*b* are connected to each other, for example, at a portion at which the distance r from the reference axis S is 0 mm to a predetermined value rx2.

In the portion, a notch 52*a* is formed in an end portion of the first member 44*a* opposite the second member 44*b*. In the portion, a notch 52*b* is formed in an end portion of the second member 44*b* opposite the first member 44*a*. Consequently, the equivalent relative dielectric constant $\varepsilon_{re}$ of the portion of the dielectric member 105 is about 2.

In the case where the first member 44*a* and the second member 44*b* are composed of the material that has a relative dielectric constant $\varepsilon_{rM}$ of about 3, and the equivalent relative dielectric constant $\varepsilon_{re}$ of the portion of the dielectric member 105 through which the reference axis S passes is about 2, it is necessary to dispose a substance that has a relative dielectric constant $\varepsilon_{rM}$ of less than 2 in the portion.

In the dielectric member 105 according to the fourth modification to the first embodiment of the present disclosure, thereforeupon, the notch 52*a* is formed in the end portion of the first member 44*a* opposite the second member 44*b*, and the notch 52*b* is formed in the end portion of the second member 44*b* opposite the first member 44*a*.

With this structure, the equivalent relative dielectric constant $\varepsilon_{re}$ of the portion of the dielectric member 105 through which the reference axis S passes can be set to about 2, and the strength can be increased by connecting the first member 44*a* and the second member 44*b* to each other.

The first member 44*a* and the second member 44*b* may be connected by using a coupling member such as a screw. In this case, the depths of the notches 52*a* and 52*b* are designed depending on, for example, the size of the coupling member.

The coupling member such as a screw is preferably composed of resin so as not to affect radio waves. In this case, the sizes and depths of the notches 52*a* and 52*b* are designed such that the equivalent relative dielectric constant $\varepsilon_{re}$ of the dielectric member 105 is the desired value in consideration of the relative dielectric constant $\varepsilon_{rM}$ of the screw.

The coupling member may be composed of material containing metal or metal to ensure sufficient strength. In this case, the coupling member is preferably thin to decrease an influence on radio waves.

[Fifth Modification]

Figure 14:
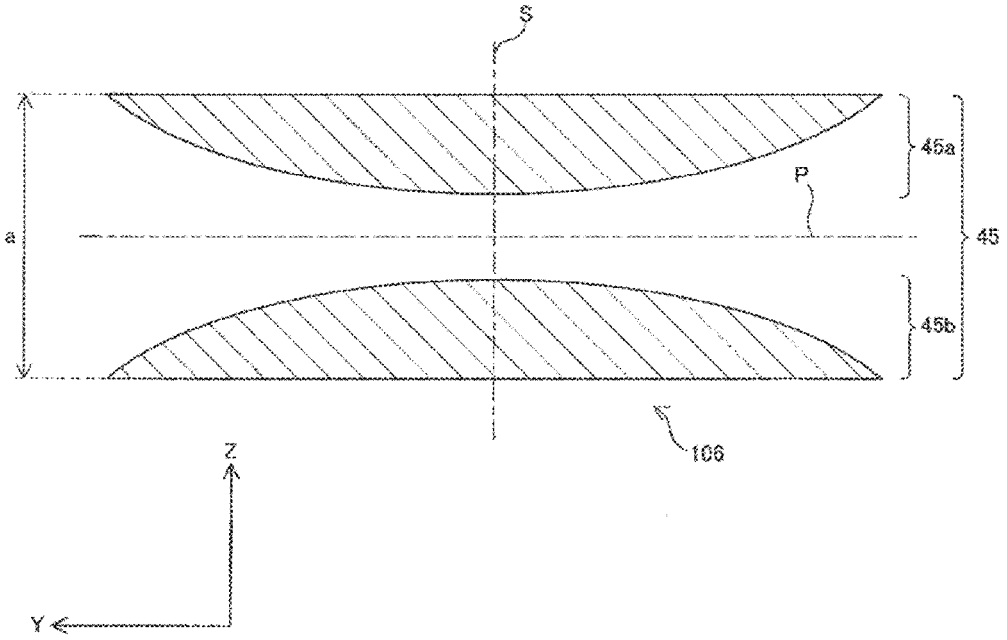
FIG. 14 illustrates the structure of a body portion of a dielectric member according to a fifth modification to the first embodiment.

FIG. 14 illustrates the structure of a body portion of a dielectric member according to a fifth modification to the first embodiment of the present disclosure.

Referring to FIG. 14, a body portion 45 of a dielectric member 106 according to the fifth modification includes a first member 45*a* and a second member 45*b*. The first member 45*a* and the second member 45*b* are plane-symmetrical to each other with the plane P centered.

The thicknesses $h_r$ of the first member 45*a* and the second member 45*b* at a position the distance r away from the reference axis S in the horizontal plane continuously decrease in a direction from the reference axis S toward the outside of the dielectric member 106, for example, such that the relationship of expression (4) described above is satisfied, when the relative dielectric constant $\varepsilon_{rM1}$ of the air that is the substance M is 1.

In the expression described above, a is the distance between an upper member and a lower member, not illustrated, in the dielectric member 106, R is the radius of the dielectric member 106, and $\varepsilon_{rM}$ is the relative dielectric constant of material of which the body portion 45 is composed.

The equivalent relative dielectric constant $\varepsilon_{re}$ of the lens 201 according to the fifth modification to the first embodiment of the present disclosure continuously decreases in the direction from the reference axis S toward the outside of the dielectric member 106.

With this structure, the radio wave radiation direction can be more flexibly set.

The first member 45*a* and the second member 45*b* can be manufactured, for example, by grinding a single member consist of resin and having a columnar shape by using a lathe. For this reason, manufacturing is easier than in the case of a dielectric lens disclosed in PTL 1.

Some features according to the first modification to the fifth modification described above can be combined.

Other embodiments of the present disclosure will now be described with reference to drawings. In the drawings, portions like or corresponding to each other are designated by like reference signs, and a description thereof is not repeated.

Second Embodiment

According to the first embodiment described above, the dielectric member 101 has a plane-symmetrical structure in the perpendicular direction. According to a second embodiment of the present disclosure, however, a dielectric member 111 of an antenna 302 has an asymmetrical structure in the perpendicular direction.

Figure 15:
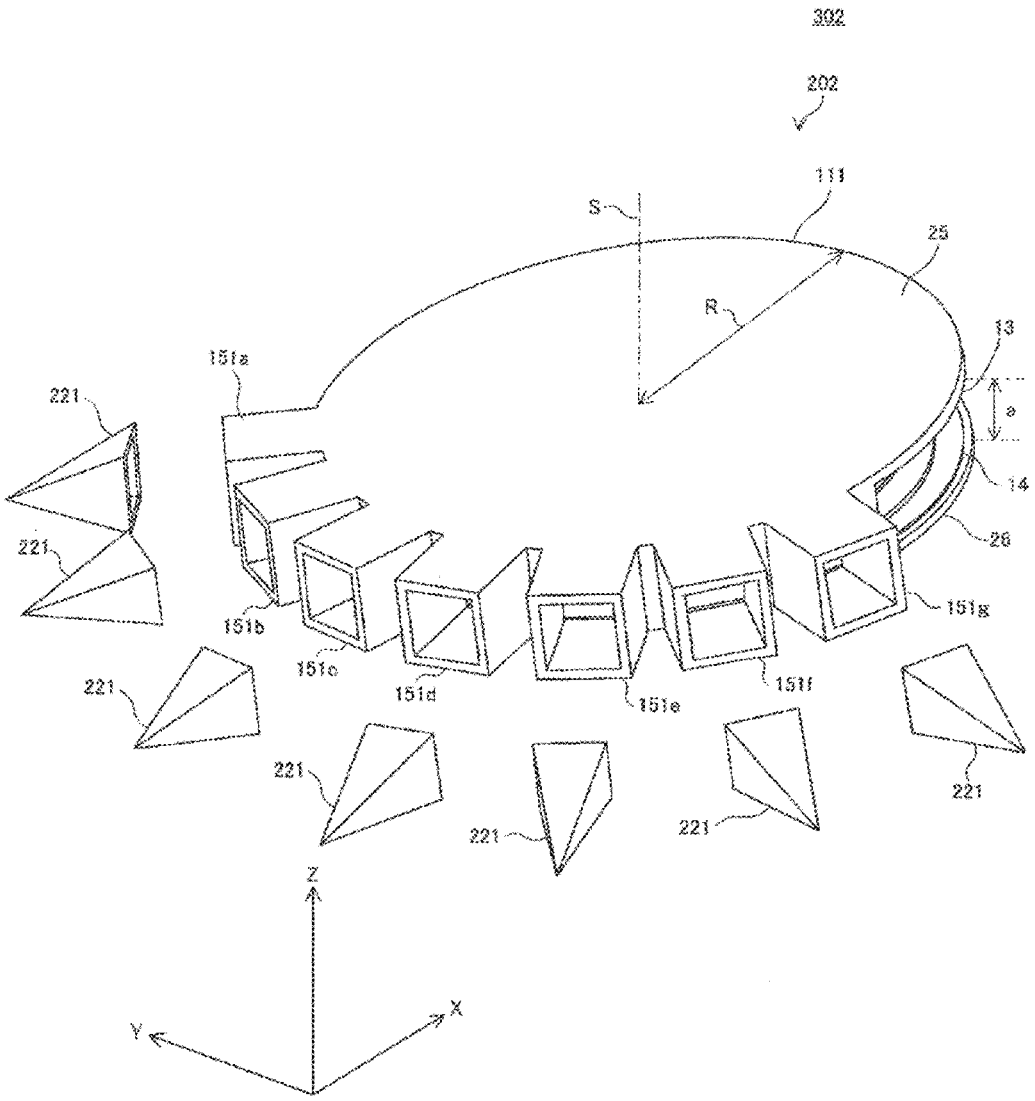
FIG. 15 illustrates the structure of an antenna according to a second embodiment.

FIG. 15 illustrates the structure of the antenna according to the second embodiment of the present disclosure.

Referring to FIG. 15, the antenna 302 includes a lens 202 and one or more radio wave radiators 221 that are disposed around the lens 202.

The lens 202 includes the dielectric member 111. The dielectric member 111 is, for example, a columnar member and has an upper surface 13 that is defined by an upper member 25 and a lower surface 14 that is defined by a lower member 26.

The upper surface 13 and the lower surface 14 of the dielectric member 111 have, for example, a circular shape that has a radius R of 30 mm.

The dielectric member 111 has an equivalent relative dielectric constant $\varepsilon_{re}$ that decreases in a direction from the reference axis S that passes through the upper surface 13 and the lower surface 14 toward the outside of the dielectric member 111. The reference axis S passes through, for example, the center of the upper surface 13 and the center of the lower surface 14 and extends in the perpendicular direction.

Figure 16:
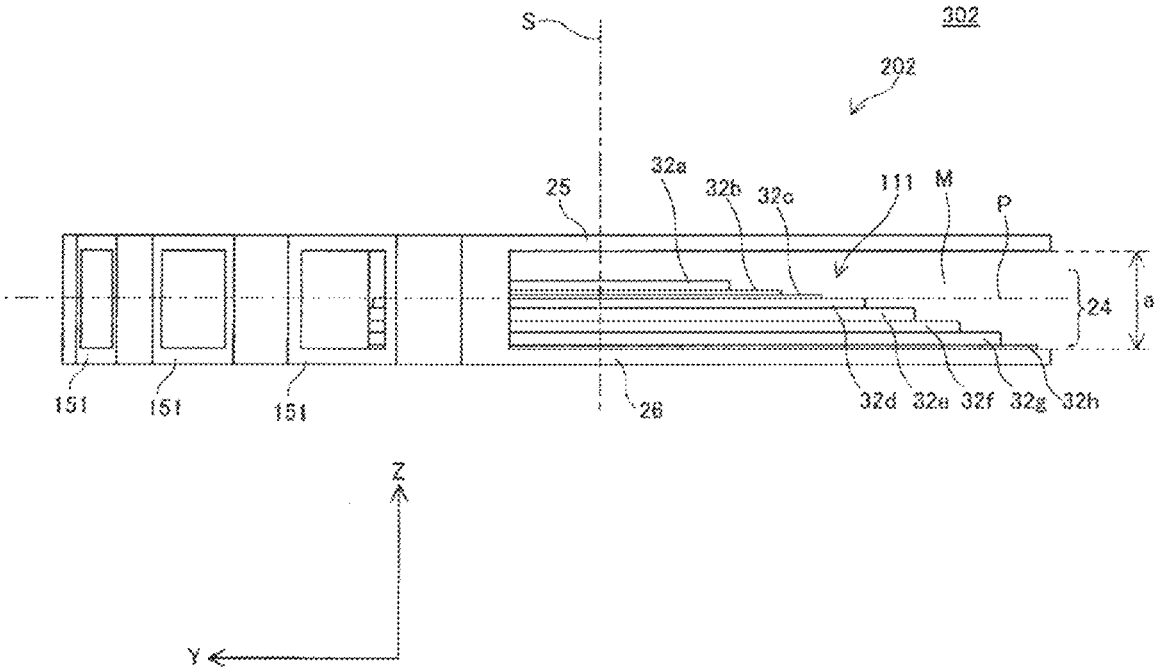
FIG. 16 is a side view of the structure of a dielectric member according to the second embodiment.

FIG. 16 is a side view of the structure of the dielectric member according to the second embodiment of the present disclosure.

Referring to FIG. 16, the dielectric member 111 includes a body portion 24 and the substance M that has a relative dielectric constant $\varepsilon_{rM}$ of less than 2. The body portion 24 and the substance M are provided between the upper member 25 and the lower member 26. Here, the substance M is air. The body portion 21 according to the first embodiment has the upper surface 11 and the lower surface 12. The body portion 24 according to the second embodiment has the lower surface 14 but does not have the upper surface 13. The upper surface 13 is defined by the upper member 25 adjacent to the substance M that is the air as described above.

The upper member 25 and the lower member 26 are composed of, for example, material containing metal or metal. A distance a between the upper member 25 and the lower member 26 is, for example, 7.112 mm.

The body portion 24 is composed of material that has a relative dielectric constant $\varepsilon_{rM}$ of 2 or more, for example, resin that has a relative dielectric constant $\varepsilon_{rM}$ of 3.

More specifically, the thickness hx of the body portion 24 decreases in a direction from the reference axis S toward the outside of the dielectric member 111, and the volume of the air between the upper member 25 and the lower member 26 consequently increases in the direction from the reference axis S toward the outside of the dielectric member 111.

Consequently, for example, the equivalent relative dielectric constant $\varepsilon_{re}$ of a portion of the dielectric member 111 through which the reference axis S passes is about 2, and the equivalent relative dielectric constant $\varepsilon_{re}$ of an outer edge portion thereof is about 1. The equivalent relative dielectric constant $\varepsilon_{re}$ of the dielectric member 111 changes stepwise from 2 to 1 in the direction from the reference axis S toward the outside of the dielectric member 111.

Specifically, as for a relationship among the relative dielectric constant $\varepsilon_{rM}$ of the material of which the body portion 24 is composed, the radius R of the dielectric member 111, the distance a between the upper member 25 and the lower member 26, and the thickness hxr of the body portion 24 at a position the distance r away from the reference axis S in the horizontal plane, the thickness hxr is designed so as to approximately satisfy an expression:

$$hxr=a\times(2-(r/R)^2-1)/(\varepsilon_{rM2}-1), \quad (5)$$

where the relative dielectric constant $\varepsilon_{rM1}$ of the air that is the substance M is 1, for example, as in the relationships in the graph G1 and the graph G2 illustrated in FIG. 6.

Here, the thickness hx of the body portion 24 changes stepwise in the direction from the reference axis S toward the outside of the dielectric member 111.

More specifically, the body portion 24 includes components 32 that are stacked along the reference axis S. Examples of the components 32 include a disk-shaped member, and the reference axis S passes through the center of a main surface. Here, the body portion 24 includes the eight components 32, that is, components 32*a*, 32*b*, 32*c*, 32*d*, 32*e*, 32*f*, 32*g*, and 32*h*.

The components 32*a* to 32*h* have the same relative dielectric constant $\varepsilon_{rM}$ and are stacked in a direction from the lower member 26 toward the upper member 25 in order of the components 32*h*, 32*g*, 32*f*, 32*e*, 32*d*, 32*c*, 32*b*, and 32*a*.

The body portion 24 has a conical shape or a truncated cone shape as a whole, and a section that passes through the reference axis S and that is along a YZ plane has a trapezoidal shape or a triangle shape as a whole. The trapezoidal shape includes a shape of a trapezoid that has a stair-like leg portion. Specifically, the radii of the components 32*a* to 32*h* are referred to as radii r11 to r18, and the radii r11 to r18 satisfy a relationship in magnitude: r11<r12<r13<r14<r15<r16<r17<r18.

In FIG. 16, the body portion 24 has a trapezoid shape in which a short side is near the upper member 25 and a long side is near the lower member 26 in a section that passes through the reference axis S and that is along the YZ plane, but the short side may be near the lower member 26, and the long side may be near the upper member 25.

The body portion 24 is not limited to being disposed near the lower member 26 and may be disposed near the upper member 25.

The lens 202 may not include the upper member 25, or the lower member 26, or both. In this case, the thickness of the dielectric member 111 is preferably set to a thickness equal to or more than a predetermined value. This predetermined value is a value that enables radio waves that propagate in the radial direction in the dielectric member 111 to pass through the inside of the dielectric member 111 before the radio waves leak out through the upper surface 13 or the lower surface 14 of the dielectric member 111, or both.

In the antenna 302 according to the second embodiment of the present disclosure, the body portion 24 is thus a member that has a conical shape or a conical trapezoidal shape.

With this structure, the radio wave radiation direction of radio waves that are transmitted and received along a plane perpendicular to the reference axis S can be changed.

In addition, the body portion 24 can be manufactured by stacking the components 32, and manufacturing is easier than in the case where both of the first member 21*a* and the second member 21*b* are manufactured as in the body portion 21 illustrated in FIG. 5.

In addition, the thickness of the outer edge portion of the body portion 24 can be more than that of the body portion 21 illustrated in FIG. 5, and the strength can be increased.

[First Modification]

Figure 17:
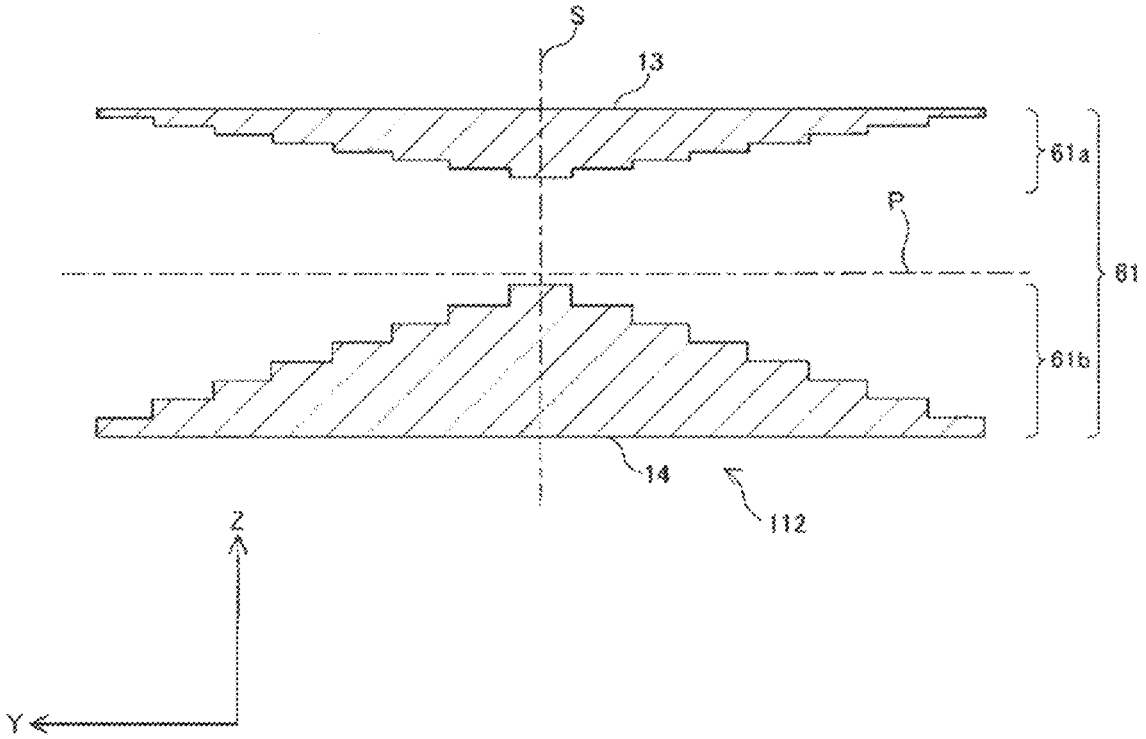
FIG. 17 illustrates the structure of a body portion of a dielectric member according to a first modification to the second embodiment.

FIG. 17 illustrates the structure of a body portion of a dielectric member according to a first modification to the second embodiment of the present disclosure.

Referring to FIG. 17, a body portion 61 of a dielectric member 112 according to the first modification includes a first member 61*a* and a second member 61*b*.

The thicknesses of the first member 61*a* and the second member 61*b* decrease stepwise in a direction from the reference axis S toward the outside of the dielectric member 112. The first member 61*a* and the second member 61*b* are asymmetrical to each other with the plane P centered.

More specifically, the thickness of a portion of the first member 61*a* at which the distance r from the reference axis S satisfies r=ra (0 mm≤ra≤R) is less than the thickness of a portion of the second member 61*b* at which the distance r satisfies r=ra.

Also, with this structure, the thickness of the body portion 61 decreases stepwise in the direction from the reference axis S toward the outside of the dielectric member 112. For this reason, the equivalent relative dielectric constant $\varepsilon_{re}$ of the dielectric member 112 decreases stepwise in the direction from the reference axis S toward the outside of the dielectric member 112.

[Second Modification]

Figure 18:
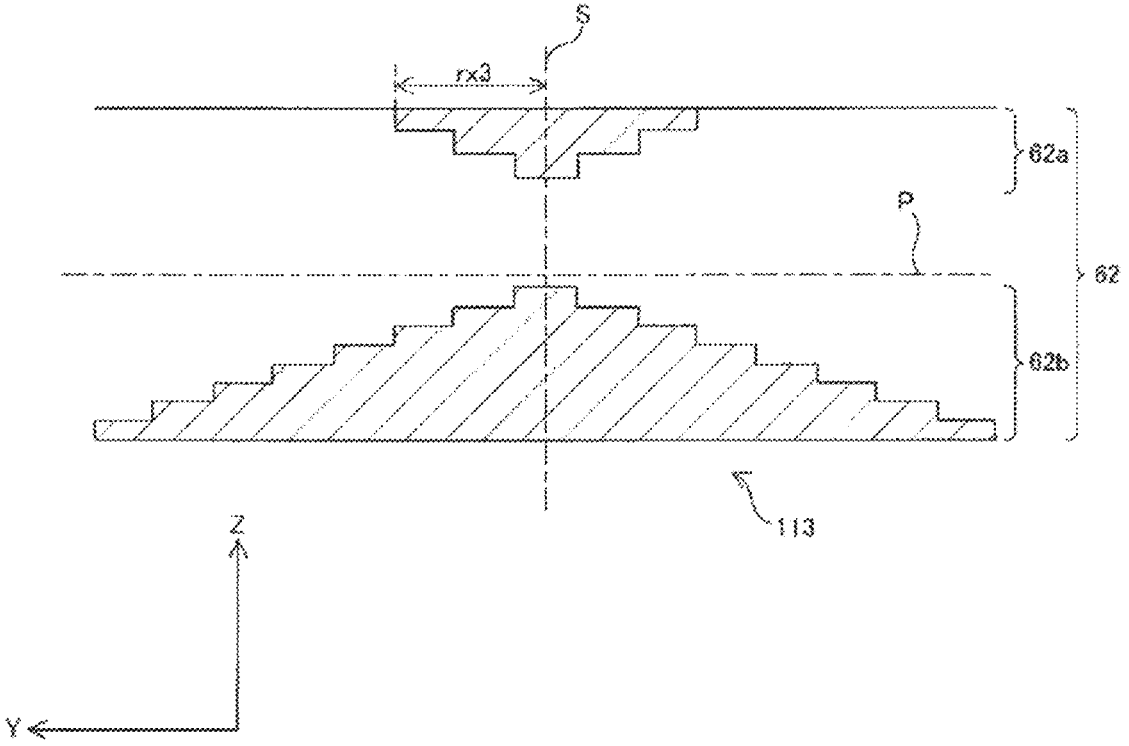
FIG. 18 illustrates the structure of a body portion of a dielectric member according to a second modification to the second embodiment of the present disclosure.

FIG. 18 illustrates the structure of a body portion of a dielectric member according to a second modification to the second embodiment of the present disclosure.

Referring to FIG. 18, a body portion 62 of a dielectric member 113 according to the second modification includes a first member 62*a* and a second member 62*b*.

The thicknesses of the first member 62*a* and the second member 62*b* decrease stepwise in a direction from the reference axis S toward the outside of the dielectric member 113. The first member 62*a* and the second member 62*b* are asymmetrical to each other with the plane P centered.

More specifically, the thickness of the first member 62*b* decreases stepwise at positions at which the distance r from the reference axis S ranges from 0 mm to R. The thickness of the second member 62*a* decreases stepwise at positions at which the distance r from the reference axis S ranges from 0 mm to rx3 (rx3<R) and is 0 mm at positions at which the distance r ranges from rx3 to R.

Also, with this structure, the thickness of the body portion 62 decreases stepwise in the direction from the reference axis S toward the outside of the dielectric member 113. For this reason, the equivalent relative dielectric constant $\varepsilon_{re}$ of the dielectric member 113 decreases stepwise in the direction from the reference axis S toward the outside of the dielectric member 113.

[Third Modification]

Figure 19:
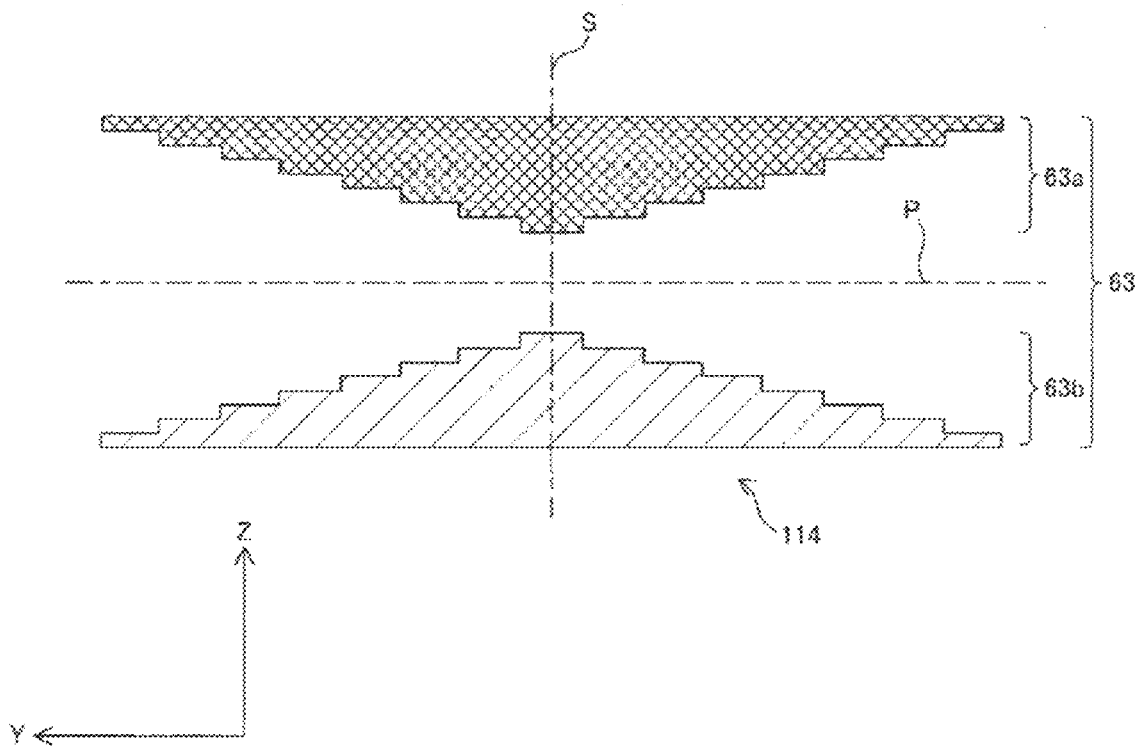
FIG. 19 illustrates the structure of a body portion of a dielectric member according to a third modification to the second embodiment.

FIG. 19 illustrates the structure of a body portion of a dielectric member according to a third modification to the second embodiment of the present disclosure.

Referring to FIG. 19, a body portion 63 of a dielectric member 114 according to the third modification includes a first member 63*a* and a second member 63*b*.

The thicknesses of the first member 63*a* and the second member 63*b* decrease stepwise in a direction from the reference axis S toward the outside of the dielectric member 114. The first member 63*a* and the second member 63*b* have the same shape.

The first member 63*a* and the second member 63*b* have different relative dielectric constants $\varepsilon_{rM}$. For example, the relative dielectric constant $\varepsilon_{rM}$ of the first member 63*a* is about 2, and the relative dielectric constant $\varepsilon_{rM}$ of the second member 63*b* is about 3.

Also, with this structure, the thickness of the body portion 63 decreases stepwise in the direction from the reference axis S toward the outside of the dielectric member 114. For this reason, the equivalent relative dielectric constant $\varepsilon_{re}$ of the dielectric member 114 decreases stepwise in the direction from the reference axis S toward the outside of the dielectric member 114.

The other structures are the same as those of the antenna 301 according to the first embodiment of the present disclosure described above, and a detailed description is not repeated herein.

Third Embodiment

The dielectric member 101 according to the first embodiment of the present disclosure described above includes the components 31 that have the same relative dielectric constant $\varepsilon_{rM}$ and that are stacked along the reference axis S. In a dielectric member 115 according to a third embodiment of the present disclosure, in contrast, components that have different relative dielectric constants $\varepsilon_{rM}$ are stacked into layers in a direction from the reference axis S toward the outside of the dielectric member 115.

[Structure]

Figure 20:
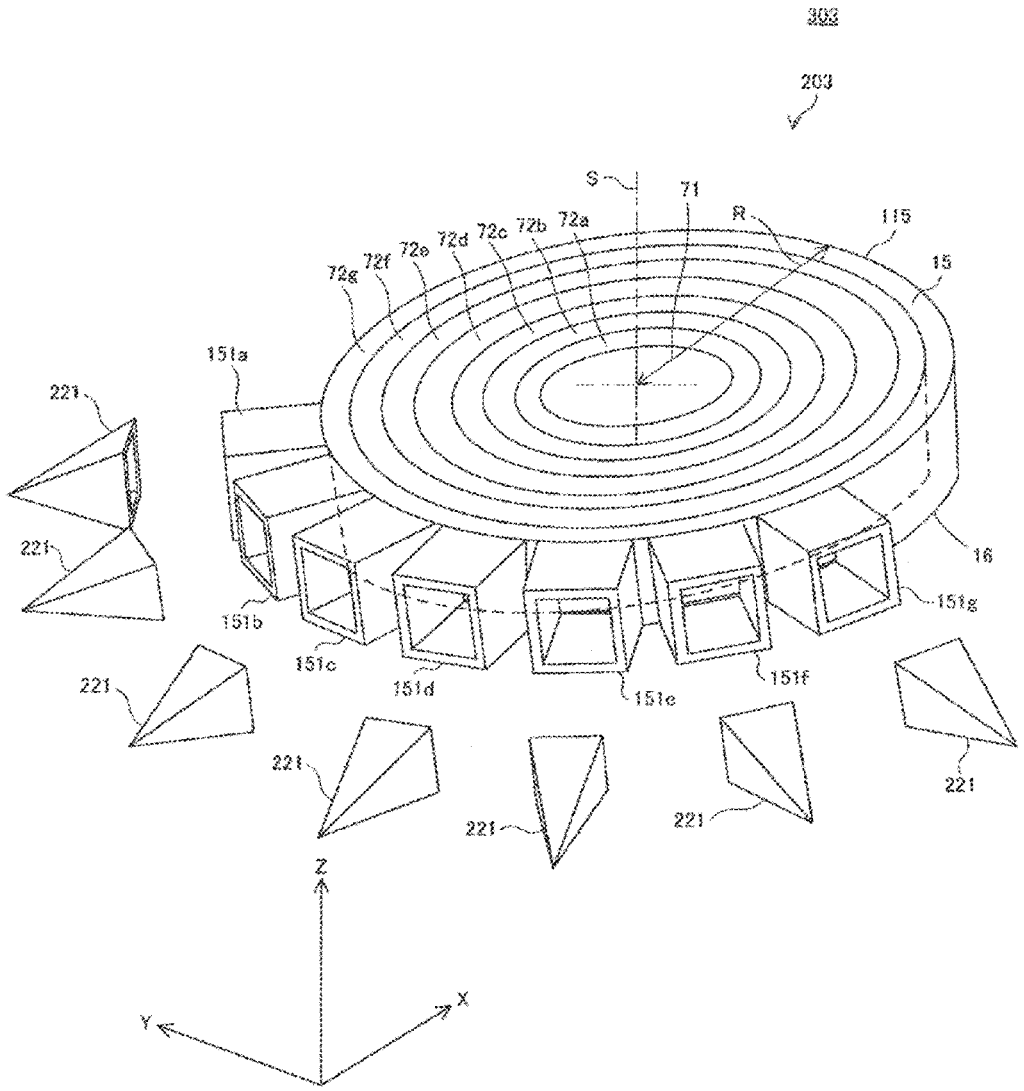
FIG. 20 is a perspective view of the structure of an antenna according to a third embodiment.

FIG. 20 is a perspective view of the structure of an antenna according to the third embodiment of the present disclosure.

Referring to FIG. 20, an antenna 303 according to the third embodiment of the present disclosure includes a lens 203 and one or more radio wave radiators 221 that are disposed around the lens 203.

The lens 203 includes the dielectric member 115. The dielectric member 115 is, for example, a columnar member and has an upper surface 15 and a lower surface 16.

The thickness of the dielectric member 115 is equal to or more than a predetermined value. This predetermined value is a value that enables radio waves that propagate in the radial direction in the dielectric member 115 to pass through the inside of the dielectric member 115 before the radio waves leak out through the upper surface 15, or the lower surface 16 of the dielectric member 115, or both. That is, since the thickness of the dielectric member 115 is equal to or more than the predetermined value, it is not necessary to dispose, for example, members composed of metal near the upper surface 15 and the lower surface 16 of the dielectric member 115, and the radio waves are prevented from leaking in the vertical direction of the dielectric member 115.

The lens 203 may include an upper member that is disposed near the upper surface 15 of the dielectric member 115, or a lower member that is disposed near the lower surface 16 of the dielectric member 115, or both.

The upper surface 15 and the lower surface 16 of the dielectric member 115 have, for example, a circular shape that has a radius R of 30 mm.

The dielectric member 115 has an equivalent relative dielectric constant $\varepsilon_{re}$ that decreases in a direction from the reference axis S that passes through the upper surface 15 and the lower surface 16 toward the outside of the dielectric member 115. The reference axis S passes through, for example, the center of the upper surface 15 and the center of the lower surface 16 and extends in the perpendicular direction.

In the dielectric member 115, there is a single kind of substance at the position the distance r away from the reference axis S. For this reason, the equivalent relative dielectric constant $\varepsilon_{re}$ at the position of the distance r is equal to the relative dielectric constant $\varepsilon_{rM}$ of the substance at the position of the distance r.

More specifically, the dielectric member 115 includes the components that have different relative dielectric constants $\varepsilon_{rM}$ and that are stacked in the direction from the reference axis S toward the outside of the dielectric member 115. Specifically, the dielectric member 115 includes a columnar member 71 and annular members 72 as the components. The columnar member 71 is disposed in a portion through which the reference axis S passes.

The number of the annular members 72 is seven. The seven annular members 72 are referred to as annular members 72*a*, 72*b*, 72*c*, 72*d*, 72*e*, 72*f*, and 72*g*, and the annular members 72*a* to 72*g* have a hollow shape and has an annular-shaped section perpendicular to the reference axis S.

The annular member 72*a* surrounds the outer circumference of the columnar member 71, the annular member 72*b* surrounds the outer circumference of the annular member 72*a*, the annular member 72*c* surrounds the outer circumference of the annular member 72*b*, the annular member 72*d* surrounds the outer circumference of the annular member 72*c*, the annular member 72*e* surrounds the outer circumference of the annular member 72*d*, the annular member 72*f* surrounds the outer circumference of the annular member 72e, and the annular member 72g surrounds the outer circumference of the annular member 72f.

The waveguides 151 are connected to, for example, the annular member 72g.

The descending order of the magnitudes of the relative dielectric constants $\varepsilon_{rM}$ is the order of those of the columnar member 71, the annular member 72a, the annular member 72b, the annular member 72c, the annular member 72d, the annular member 72e, the annular member 72f, and the annular member 72g. Specifically, the relative dielectric constant $\varepsilon_{rM}$ of the columnar member 71 is about 2, and the relative dielectric constant $\varepsilon_{rM}$ of the annular member 72g that forms an outer edge portion of the dielectric member 115 is about 1.

Consequently, the equivalent relative dielectric constant $\varepsilon_{re}$ of the dielectric member 115 decreases stepwise from 2 to 1 in a direction form the reference axis S toward the outside of the dielectric member 115.

[Manufacturing Method]

Figure 21:
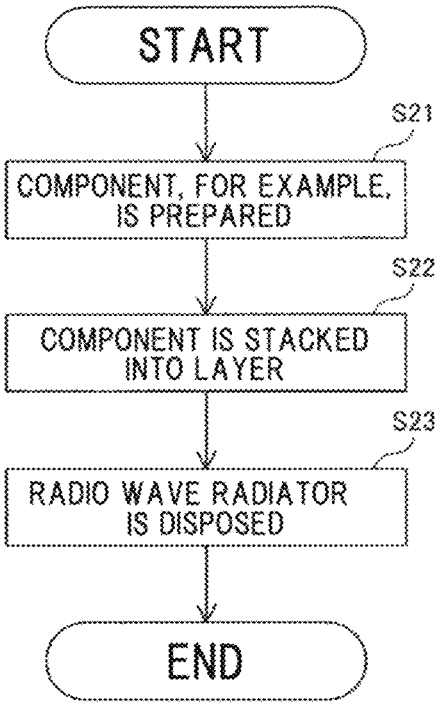
FIG. 21 illustrates a flowchart in which procedures for a method of manufacturing the antenna according to the third embodiment are defined.

FIG. 21 illustrates a flowchart in which procedures for a method of manufacturing the antenna according to the third embodiment of the present disclosure are defined.

Referring to FIG. 21, an operator first prepares the components of the dielectric member 115, that is, a member that includes the columnar member 71, the annular members 72a to 72g, and the waveguides 151, and the radio wave radiators 221 (step S21).

Subsequently, the operator stacks the columnar member 71 and the annular members 72a to 72g into layers in the direction from the reference axis S toward the outside of the dielectric member 115 (step S22).

The operator disposes the radio wave radiators 221 at positions at which the radio wave radiators 221 face the respective waveguides 151 around the lens 203 in which the columnar member 71 and the annular members 72a to 72g are stacked (step S23).

In the antenna 303 according to the third embodiment of the present disclosure, the dielectric member 115 thus includes the components that have different relative dielectric constants $\varepsilon_{rM}$, that is, the columnar member 71 and the annular members 72a to 72g. The columnar member 71 and the annular members 72a to 72g are stacked into the layers in the direction from the reference axis S toward the outside of the dielectric member 115.

The dielectric member 115 can be readily manufactured such that the equivalent relative dielectric constant $\varepsilon_{re}$ changes by a simple element of stacking the columnar member 71 and the annular members 72a to 72g into the layers.

In the antenna 303 according to the third embodiment of the present disclosure, the thickness of the dielectric member 115 is designed such that the radio waves that propagate in the dielectric member 115 are inhibited from leaking out through the upper surface 15 and the lower surface 16.

With this structure, it is not necessary to dispose, for example, members composed of metal near the upper surface 15 and the lower surface 16 of the dielectric member 115, and the radio waves are prevented from leaking in the vertical direction of the dielectric member 115.

In the method of manufacturing the antenna 303 according to the third embodiment of the present disclosure, the operator first prepares the columnar member 71 and the annular members 72a to 72g that have different relative dielectric constants $\varepsilon_{rM}$. The operator manufactures the dielectric member 115 by stacking the columnar member 71 and the annular members 72a to 72g into the layers in the direction from the reference axis S toward the outside described above such that the equivalent relative dielectric constant $\varepsilon_{re}$ decreases in the direction from the reference axis S that passes through the upper surface 15 and the lower surface 16 of the dielectric member 115 toward the outside of the dielectric member 115.

Since the equivalent relative dielectric constant $\varepsilon_{re}$ of the lens 203 thus decreases in the direction from the reference axis S toward the outside of the dielectric member 115, the radio wave radiation direction can be readily changed. Since the dielectric member 115 has the upper surface 15 and the lower surface 16, a specific mold, for example, is not needed, and the lens 203 can be readily manufactured unlike the case where a spherical lens is manufactured.

Moreover, the dielectric member 115 can be readily manufactured such that the equivalent relative dielectric constant $\varepsilon_{re}$ changes by a simple method of stacking the columnar member 71 and the annular members 72a to 72g into the layers.

Accordingly, the method of manufacturing the antenna 303 according to the third embodiment of the present disclosure enables the lens 203 that can change the radio wave radiation direction to be more readily manufactured.

The other structures are the same as those of the antenna 301 according to the first embodiment of the present disclosure described above, and a detailed description is not repeated herein.

The features of the antenna 301 according to the first embodiment of the present disclosure and the first modification to the fifth modification to the first embodiment, the antenna 302 according to the second embodiment and the first modification to the third modification to the second embodiment, and the antenna 303 according to the third embodiment can be appropriately combined.

It should be thought that the embodiments are described above by way of example in all aspects and are not restrictive. The scope of the present invention is not shown by the above description but is shown by the scope of claims and includes all modifications having the same meaning and range as the scope of the claims.

[Additional Remarks]

(A-1) A lens including a dielectric member that has an upper surface and a lower surface and having an equivalent relative dielectric constant that decreases in a direction from a reference axis that passes through the upper surface and the lower surface toward the outside of the dielectric member.

Since the equivalent relative dielectric constant of the lens decreases in the direction from the reference axis toward the outside of the dielectric member as in (A-1) described above, the radio wave radiation direction can be readily changed. Since the dielectric member has the upper surface and the lower surface, a specific mold, for example, is not needed, and the lens can be readily manufactured unlike the case where a spherical lens is manufactured. Accordingly, the lens that can change the radio wave radiation direction can be more readily manufactured.

(A-2) The lens described in (A-1), in which the dielectric member is a columnar member.

With the structure in (A-2) described above, the degree of freedom of a position at which a radio wave radiator can be disposed so as to face a side surface of the dielectric member increases, and the radio wave radiation direction can be consequently changed within an increased range.

(A-3) The lens described in (A-1) or (A-2), in which the dielectric member includes multiple components that have different relative dielectric constants, and the multiple components are stacked into layers in the direction from the reference axis toward the outside of the dielectric member.

The dielectric member can be readily manufactured such that the equivalent relative dielectric constant changes by a simple element of stacking the components into the layers as in (A-3) described above.

(A-4) The lens described in any one of (A-1) to (A-3), in which the thickness of the dielectric member is set such that radio waves that propagate in the dielectric member are inhibited from leaking out through the upper surface and the lower surface.

With the structure in (A-4) described above, it is not necessary to dispose, for example, members composed of metal near the upper surface and the lower surface of the dielectric member, and the radio waves can be prevented from leaking in the vertical direction of the dielectric member.

(A-5) The lens described in (A-1) or (A-2), in which the dielectric member includes a body portion that has a relative dielectric constant of 2 or more, and the thickness of the body portion decreases in the direction from the reference axis toward the outside of the dielectric member.

The dielectric member can be readily manufactured such that the equivalent relative dielectric constant changes because of a simple structure in which the thickness of the body portion decreases in the direction from the reference axis toward the outside of the dielectric member as in (A-5) described above. Since the relative dielectric constant of the body portion is 2 or more, the equivalent relative dielectric constant of a portion of the dielectric member through which the reference axis passes can be set to 2 or more.

(A-6) The lens described in (A-5), in which the body portion is a member that has a conical shape or a conical trapezoidal shape.

With the structure in (A-6) described above, the radio wave radiation direction of radio waves that are transmitted and received along a plane perpendicular to the reference axis can be changed.

(A-7) The lens described in (A-5) or (A-6), in which a portion of the dielectric member other than the body portion contains a substance that has a relative dielectric constant of less than 2.

With the structure in (A-7) described above, the equivalent relative dielectric constant of the dielectric member can be readily changed by changing a volume ratio between the body portion that has a relative dielectric constant of 2 or more and the substance that has a relative dielectric constant of less than 2.

(A-8) The lens described in (A-7), in which the dielectric member includes, as the substance, a member that has a relative dielectric constant of more than 1.

With the structure in (A-8) described above, for example, the body portion is supported by using the member described above, and the strength of the dielectric member can be increased.

(A-9) The lens described in any one of (A-5) to (A-8), in which the lens has an equivalent relative dielectric constant that continuously decreases in the direction from the reference axis toward the outside of the dielectric member.

With the structure in (A-9) described above, the radio wave radiation direction can be more flexibly set.

(A-10) The lens described in any one of (A-5) to (A-8), in which the body portion includes multiple components that are stacked along the reference axis and that have the same relative dielectric constant.

The body portion can be readily manufactured such that the thickness changes by a simple element of stacking the components that have the same relative dielectric constant along the reference axis as in (A-10) described above.

(A-11) The lens described in any one of (A-5) to (A-10), in which the body portion is formed by a cutting process.

With the structure in (A-11) described above, a work such as stacking and sticking members is not needed, the body portion of the dielectric member can be manufactured from an integral component, a manufacturing work can be consequently simplified, and manufacturing costs can be consequently reduced.

(A-12) The lens described in any one of (A-5) to (A-11), in which the body portion includes a first member and a second member that is connected to the first member at the portion through which the reference axis passes.

With the structure in (A-12) described above, the strength of the dielectric member can be increased in the case where the body portion includes the members.

(A-13) The lens described in any one of (A-1) to (A-12), in which the lens further includes an upper member that is disposed near the upper surface of the dielectric member and a lower member that is disposed near the lower surface of the dielectric member.

With the structure in (A-13) described above, radio waves can be prevented from leaking in the vertical direction of the dielectric member.

(A-14) An antenna including a lens that includes a dielectric member and a radio wave radiator that is disposed around the lens, in which the dielectric member has an upper surface and a lower surface and has an equivalent relative dielectric constant that decreases in a direction from a reference axis that passes through the upper surface and the lower surface toward the outside of the dielectric member.

Since the equivalent relative dielectric constant of the lens decreases in the direction from the reference axis toward the outside of the dielectric member as in (A-14) described above, the radio wave radiation direction can be readily changed. Since the dielectric member has the upper surface and the lower surface, a specific mold, for example, is not needed, and the lens can be readily manufactured unlike the case of a spherical lens. Accordingly, the antenna that includes the lens that can change the radio wave radiation direction can be more readily manufactured.

(A-15) The antenna described in (A-14), in which the height of an opening portion of the radio wave radiator is equal to or less than the thickness of the dielectric member.

With the structure in (A-15) described above, a radio wave is inhibited from leaking near the boundary between the radio wave radiator and the dielectric member when the radio wave is radiated from the antenna.

(A-16) The antenna described in (A-14), in which the height of the opening portion of the radio wave radiator is equal to or more than the thickness of the dielectric member.

With the structure in (A-16) described above, a radio wave can be inhibited from leaking near the boundary between the radio wave radiator and the dielectric member when the radio wave is received by the antenna.

(A-17) The antenna described in (A-14), in which the height of the opening portion of the radio wave radiator is equal to the thickness of the dielectric member.

With the structure in (A-17) described above, radio waves can be inhibited from leaking near the boundary between the radio wave radiator and the dielectric member when the radio wave is radiated from the antenna and when the radio wave is received by the antenna.

(A-18) The antenna described in any one of (A-15) to (A-17), in which the opening portion and the dielectric member are coupled with each other with a member that is composed of material that contains metal or metal interposed therebetween.

With the structure in (A-18) described above, a radio wave can be prevented from leaking near the boundary between the radio wave radiator and the dielectric member with more certainty.

(A-19) A device for vehicle including an antenna, in which the antenna includes a lens that includes a dielectric member and a radio wave radiator that is disposed around the lens, and the dielectric member has an upper surface and a lower surface and has an equivalent relative dielectric constant that decreases in a direction from a reference axis that passes through the upper surface and the lower surface toward the outside of the dielectric member.

Since the equivalent relative dielectric constant of the lens decreases in the direction from the reference axis toward the outside of the dielectric member as in (A-19) described above, the radio wave radiation direction can be readily changed. Since the dielectric member has the upper surface and the lower surface, a specific mold, for example, is not needed, and the lens can be readily manufactured unlike the case of a spherical lens. Accordingly, the antenna that includes the lens that can change the radio wave radiation direction can be more readily manufactured.

(A-20) A method of manufacturing a lens that includes a dielectric member, including a step of preparing multiple components that have different relative dielectric constants, and a step of manufacturing the dielectric member by stacking the multiple components into layers in a direction from a reference axis toward the outside such that an equivalent relative dielectric constant decreases in the direction from the reference axis that passes through an upper surface and a lower surface of the dielectric member toward the outside of the dielectric member.

Since the equivalent relative dielectric constant of the lens decreases in the direction from the reference axis toward the outside of the dielectric member as in (A-20) described above, the radio wave radiation direction can be readily changed. Since the dielectric member has the upper surface and the lower surface, a specific mold, for example, is not needed, and the lens can be readily manufactured unlike the case of a spherical lens.

In addition, the dielectric member can be readily manufactured such that the relative dielectric constant changes by a simple method of stacking the components into the layers.

Accordingly, the lens that can change the radio wave radiation direction can be more readily manufactured.

(A-21) A method of manufacturing a lens that includes a dielectric member, including a step of preparing multiple components that have the same relative dielectric constant, and a step of manufacturing the dielectric member by stacking the multiple components along a reference axis such that an equivalent relative dielectric constant decreases in a direction from the reference axis that passes through an upper surface and a lower surface of the dielectric member toward the outside of the dielectric member.

Since the equivalent relative dielectric constant of the lens decreases in the direction from the reference axis toward the outside of the dielectric member as in (A-21) described above, the radio wave radiation direction can be readily changed. Since the dielectric member has the upper surface and the lower surface, a specific mold, for example, is not needed, and the lens can be readily manufactured unlike the case of a spherical lens.

In addition, the dielectric member can be readily manufactured such that the dielectric constant changes by a simple method of stacking the components that have the same relative dielectric constant along the reference axis.

Accordingly, the lens that can change the radio wave radiation direction can be more readily manufactured.

(A-22) A method of manufacturing a lens that includes a dielectric member, including a step of preparing a component and a step of cutting the component such that an equivalent relative dielectric constant decreases in a direction from a reference axis that passes through an upper surface and a lower surface of the dielectric member toward the outside of the dielectric member.

Since the equivalent relative dielectric constant of the lens decreases in the direction from the reference axis toward the outside of the dielectric member as in (A-22) described above, the radio wave radiation direction can be readily changed. Since the dielectric member has the upper surface and the lower surface, a specific mold, for example, is not needed, and the lens can be readily manufactured unlike the case of a spherical lens.

In addition, a work such as stacking and sticking members is not needed, the dielectric member can be manufactured from an integral component, a manufacturing work can be consequently simplified, and manufacturing costs can be consequently reduced.

(B-1) A lens including a dielectric member that has an upper surface and a lower surface, in which an equivalent relative dielectric constant decreases in a direction from a reference axis that passes through the upper surface and the lower surface toward the outside of the dielectric member, the reference axis passes through the center of the upper surface and the center of the lower surface and extends in the perpendicular direction, the dielectric member includes multiple components that are stacked along the reference axis and that have the same relative dielectric constant, the components are disk-shaped members, and the reference axis passes through the center of a main surface of each component.

(B-2) An antenna including a lens that includes a dielectric member, and a radio wave radiator that is disposed around the lens, in which the dielectric member has an upper surface and a lower surface, and an equivalent relative dielectric constant decreases in a direction from a reference axis that passes through the upper surface and the lower surface toward the outside of the dielectric member, the lens further includes a waveguide, and the radio wave radiator is a horn antenna and is disposed at a position at which the radio wave radiator faces the waveguide.

REFERENCE SIGNS LIST

11, 13, 15 first surface (upper surface)
12, 14, 16 second surface (lower surface)
18 outer circumference
21, 24, 41, 42, 43, 44, 45, 61, 62, 63 first substance (body portion)
21*a*, 41*a*, 42*a*, 43*a*, 44*a*, 45*a*, 61*a*, 62*a*, 63*a* first member
21*b*, 41*b*, 42*b*, 43*b*, 44*b*, 45*b*, 61*b*, 62*b*, 63*b* second member
22, 25 upper member
23, 26 lower member
31, 31*a* to 31*h*, 32, 32*a* to 32*h* component
51 low relative dielectric constant member

52*a*, 52*b* notch
71 columnar member
72, 72*a* to 72*g* annular member
101 to 106, 111 to 115 dielectric member
151, 151*a* to 151*g* waveguide
171*a* to 171*g* focal point
161 wireless base station device
201, 202, 203 lens
221 radio wave radiator
301, 302, 303 antenna
401 device for vehicle
B radio wave
M second substance
P two-dimensional plane
S reference axis
Z direction of the reference axis

The invention claimed is:

1. A lens comprising:

a dielectric having a first surface and a reference axis that extends along a first direction intersecting the first surface and passes through a center of the first surface, wherein the dielectric has an equivalent relative dielectric constant that decreases along a second direction from the reference axis toward outer circumferences of the first surface, and the second direction is different from the first direction and is a direction along the first surface, and a first substance that has a first relative dielectric constant and a second substance that has a second relative dielectric constant larger than the first relative dielectric constant are disposed side by side in the first direction, wherein the second substance comprises two second substances, and the two second substances are respectively located on both sides of the first substance in the first direction and separated by the first substance at a portion through which the reference axis passes.

2. The lens according to claim 1, wherein in the dielectric, a proportion of the second substance in the direction of the reference axis decreases in the direction from the reference axis toward the outer circumferences.

3. The lens according to claim 2, wherein the second substance includes multiple components that are stacked in the direction of the reference axis.

4. The lens according to claim 2, wherein the second substance is subjected to a cutting process.

5. The lens according to claim 1, wherein the first substance is air.

6. The lens according to claim 1, wherein the first relative dielectric constant is less than 2.

7. The lens according to claim 1, wherein the second relative dielectric constant is 2 or more.

8. The lens according to claim 1, wherein the dielectric has a second surface, which is disposed with respect to the first surface in the first direction at a predetermined interval, and the lens further comprising:

a member that prevents a radio wave from leaking through the first surface; and a member that prevents a radio wave from leaking through the second surface.

9. The lens according to claim 1, wherein the dielectric has a second surface, which is disposed with respect to the first surface in the first direction at a predetermined interval, and the lens further comprising:

a waveguide that is disposed on the outer circumferences of the first surface and the second surface.

10. The lens according to claim 1, wherein the dielectric has a second surface, which is disposed with respect to the first surface in the first direction at a predetermined interval, and the lens further comprising:

a member that prevents a radio wave from leaking through the first surface;

a member that prevents a radio wave from leaking through the second surface; and a waveguide that is disposed on the outer circumferences of the first surface and the second surface, wherein the waveguide is integrally formed with the member that prevents the radio wave from leaking through the first surface and the member that prevents the radio wave from leaking through the second surface.

11. The lens according to claim 1, wherein a length of the dielectric in the direction of the reference axis is equal to or less than twice a wavelength of a radio wave that propagates in the dielectric.

12. A two-dimensional Luneburg lens that changes a radio wave radiation direction into a direction parallel to a two-dimensional plane depending on a two-dimensional position of a radio wave radiator in the two-dimensional plane, the lens comprising:

a first substance that has a first relative dielectric constant; and a second substance that is disposed side by side with the first substance in a direction perpendicular to the two-dimensional plane and that has a relative dielectric constant different from the first relative dielectric constant, wherein the second substance comprises two second substances, and the two second substances are located on both sides of the first substance in a direction of a reference axis passing through a center of the two-dimensional plane and separated by the first substance at a portion through which the reference axis passes.

13. An antenna comprising:

a lens including a dielectric having a first surface and a second surface that is spaced from the first surface and that faces the first surface in a direction of a reference axis intersecting the first surface and passing through a center of the first surface; and a radio wave radiator that is disposed on outer circumferences of the first surface and the second surface, wherein a reference axis that extends along a first direction intersecting the first surface, the dielectric has an equivalent relative dielectric constant that decreases along a second direction from the reference axis toward the outer circumferences of the first surface and the second surface, the second direction is different from the first direction and is a direction along the first surface, and a first substance that has a first relative dielectric constant and a second substance that has a second relative dielectric constant larger than the first relative dielectric constant are disposed side by the side in the first direction, wherein the second substance comprises two second substances, and the two second substances are respectively located on both sides of the first substance in the first direction and separated by the first substance at a portion through which the reference axis passes.

14. The antenna according to claim 13, wherein a length of the radio wave radiator in the direction of the reference axis is equal to or less than a length of the dielectric in the direction of the reference axis.

15. The antenna according to claim 13, wherein a length of the radio wave radiator in the direction of the reference axis is equal to or more than a length of the dielectric in the direction of the reference axis.

16. The antenna according to claim 13, wherein a length of the radio wave radiator in the direction of the reference axis is equal to a length of the dielectric in the direction of the reference axis.

17. The antenna according to claim 13, further comprising:

a waveguide that is disposed between the radio wave radiator and the dielectric.

18. A device for vehicle comprising: an antenna, wherein the antenna includes a lens including a dielectric having a first surface and a second surface that is spaced from the first surface and that faces the first surface in a direction of a reference axis intersecting the first surface and passing through a center of the first surface, and a radio wave radiator that is disposed on outer circumferences of the first surface and the second surface, and wherein a reference axis that extends along a first direction intersecting the first surface, the dielectric has an equivalent relative dielectric constant that decreases along a second direction from the reference axis toward the outer circumferences of the first surface and the second surface, the second direction is different from the first direction and is a direction along the first surface, and a first substance that has a first relative dielectric constant and a second substance that has a second relative dielectric constant larger than the first relative dielectric constant are disposed side by the side in the first direction, wherein the second substance comprises two second substances, and the two second substances are respectively located on both sides of the first substance in the first direction and separated by the first substance at a portion through which the reference axis passes.

19. The lens according to claim 1, wherein the second substances are located on both sides of the first substance in the first direction.

* * * * *